US010814636B2

(12) United States Patent
Kimura et al.

(10) Patent No.: US 10,814,636 B2
(45) Date of Patent: Oct. 27, 2020

(54) LIQUID EJECTION APPARATUS

(71) Applicant: SEIKO EPSON CORPORATION, Tokyo (JP)

(72) Inventors: Naomi Kimura, Okaya (JP); Makoto Sawadaishi, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/373,350

(22) Filed: Apr. 2, 2019

(65) Prior Publication Data

US 2019/0299622 A1 Oct. 3, 2019

(30) Foreign Application Priority Data

Apr. 3, 2018 (JP) ..... 2018-071381

(51) Int. Cl.
*B41J 2/175* (2006.01)
*B41J 25/00* (2006.01)
*B41J 2/19* (2006.01)

(52) U.S. Cl.
CPC ..... *B41J 2/175* (2013.01); *B41J 2/17563* (2013.01); *B41J 2/19* (2013.01); *B41J 25/001* (2013.01)

(58) Field of Classification Search
CPC . B41J 2/175; B41J 2/19; B41J 2/17563; B41J 25/001; B41J 2/17509; B41J 2/1752; B41J 2/17553; B41J 2/17513; B41J 2/17596
See application file for complete search history.

(56) References Cited

U.S. PATENT DOCUMENTS 9,469,118 B2 * 10/2016 Kimura ..... B41J 2/17513
2015/0109386 A1 4/2015 Koike et al.

FOREIGN PATENT DOCUMENTS

JP 2015-080907 A 4/2015

OTHER PUBLICATIONS

IP.com search (Year: 2020).*

* cited by examiner

*Primary Examiner* — Lisa Solomon
(74) *Attorney, Agent, or Firm* — Oliff PLC

(57) ABSTRACT

Provided is a liquid ejection apparatus configured to suppress the occurrence of an inconvenience caused by waves in a liquid. The liquid ejection apparatus includes: a liquid ejection head; a liquid container configured to supply the liquid to the liquid ejection head; and a carriage that is for arranging the liquid ejection head and the liquid container and is configured to perform a reciprocal movement. The liquid container includes: a liquid containing chamber that is configured to contain the liquid; an atmospheric air introduction port that introduces atmospheric air into the liquid containing chamber from outside. The atmospheric air introduction port is arranged at a position higher than the highest level of a wave that occurs due to the reciprocal movement in a full state in which the liquid containing chamber is filled with liquid to the highest level in a predetermined containing range.

11 Claims, 12 Drawing Sheets

LIQUID EJECTION APPARATUS

The present application is based on, and claims priority from JP Application Serial Number 2018-071381, filed Apr. 3, 2018, the disclosure of which is hereby incorporated by reference herein in its entirety.

BACKGROUND

1. Technical Field

The present disclosure relates to a liquid ejection apparatus.

2. Related Art

Hereinbefore, a liquid containing container has been known which includes: a containing portion configured to contain a liquid; and an atmospheric air introduction portion configured to introduce atmospheric air into the containing portion from the outside, a communication port in communication with the atmospheric air introduction portion being arranged in the containing portion (e.g., see JP-A-2015-80907).

JP-A-2015-80907 is an example of the related art.

However, when the above-described liquid containing container is applied to a so-called on-carriage type of printer, the liquid contained in the containing portion is agitated due to the reciprocal movement (sliding operation) of the carriage, and thus waves are formed in the liquid, and the liquid in which the waves are formed sticks in the form of a film to the communication port in some cases. Upon doing so, when air enters the containing portion through an atmospheric air introduction portion when the liquid is in the form of a film, the film expands, and when the expanded film ruptures, minute air bubbles are formed and disperse in the containing chamber. Then, when the air bubbles dispersed in the containing chamber flow toward the liquid ejection head, a liquid ejection inconvenience occurs, which is a problem.

SUMMARY

A liquid ejection apparatus of the present disclosure includes: a liquid ejection head that ejects a liquid; a liquid container that is in communication with the liquid ejection head and is configured to supply the liquid to the liquid ejection head; and a carriage that is for arranging the liquid ejection head and the liquid container and is configured to perform a reciprocal movement. The liquid container includes: a liquid containing chamber that is configured to contain the liquid; a liquid injection port that is configured to inject the liquid into the liquid containing chamber from outside; an atmospheric air introduction port that introduces atmospheric air into the liquid containing chamber from the outside; and a liquid supply port that is configured to supply the liquid to the outside from the liquid containing chamber. The liquid containing chamber includes: an upper wall in a use state; a bottom wall opposing the upper wall; a first wall that intersects the upper wall and the bottom wall and is parallel to the direction of the reciprocal movement; a second wall opposing the first wall; a third wall that intersects the first wall and the second wall; and a fourth wall opposing the third wall. The atmospheric air introduction port is arranged at a position higher than the highest level of a wave that occurs due to the reciprocal movement in a full state in which the liquid containing chamber is filled with liquid to the highest level in a predetermined containing range.

The atmospheric air introduction port of the above-described liquid ejection apparatus may be located at an end portion of a hollow protrusion protruding toward the fourth wall from the third wall.

The hollow protrusion of the above-described liquid ejection apparatus may be provided protruding from the third wall to an intermediate position between the third wall and the fourth wall.

The atmospheric air introduction port of the above-described liquid ejection apparatus may be arranged between the first wall and a fifth wall that is provided between the first wall and the second wall and opposes the first wall, and the liquid containing chamber may include a rib arranged between a liquid surface of the liquid in the full state and the atmospheric air introduction port, the rib being coupled to the third wall and protruding toward the fifth wall from the first wall.

In the above-described liquid ejection apparatus, a gap may be provided between an end portion on the fifth wall side of the rib and the fifth wall.

In the above-described liquid ejection apparatus, letting the rib be a first rib, the liquid containing chamber may include a second rib that is arranged between the liquid surface of the liquid in the full state and the atmospheric air introduction port, the second rib being coupled to the third wall and protruding toward the first wall from the fifth wall.

In the above-described liquid ejection apparatus, a gap may be provided between an end portion on the first wall side of the second rib and the first wall.

In the above-described liquid ejection apparatus, the liquid container may include: a negative pressure generation mechanism provided between the liquid containing chamber and the liquid supply port; an upstream liquid communication path through which the liquid containing chamber and the negative pressure generation mechanism are in communication; and a downstream liquid communication path through which the negative pressure generation mechanism and the liquid supply port are in communication. The upstream liquid communication path may be in a positive pressure state, the downstream liquid communication path may be in a negative pressure state, and at least a portion of the upstream liquid communication path may include a defoaming portion that eliminates air bubbles in the liquid.

The defoaming portion of the above-described liquid ejection apparatus may be constituted by a winding path provided on the upstream liquid communication path.

In the above-described liquid ejection apparatus, a filter that traps the air bubbles may be provided on the upstream liquid communication path.

In the above-described liquid ejection apparatus, the bottom wall may be provided with a liquid outflow port that allows the liquid to flow out from the liquid containing chamber to the upstream liquid communication path, and the liquid outflow port may be arranged near the filter.

In the above-described liquid ejection apparatus, a viewing portion through which an amount of the liquid contained in the liquid containing chamber can be viewed from the outside may be provided in at least one of the first wall and the second wall.

DESCRIPTION OF EXEMPLARY EMBODIMENTS

Embodiments

First, a configuration of a liquid ejection apparatus 1 will be described.

Figure 1:
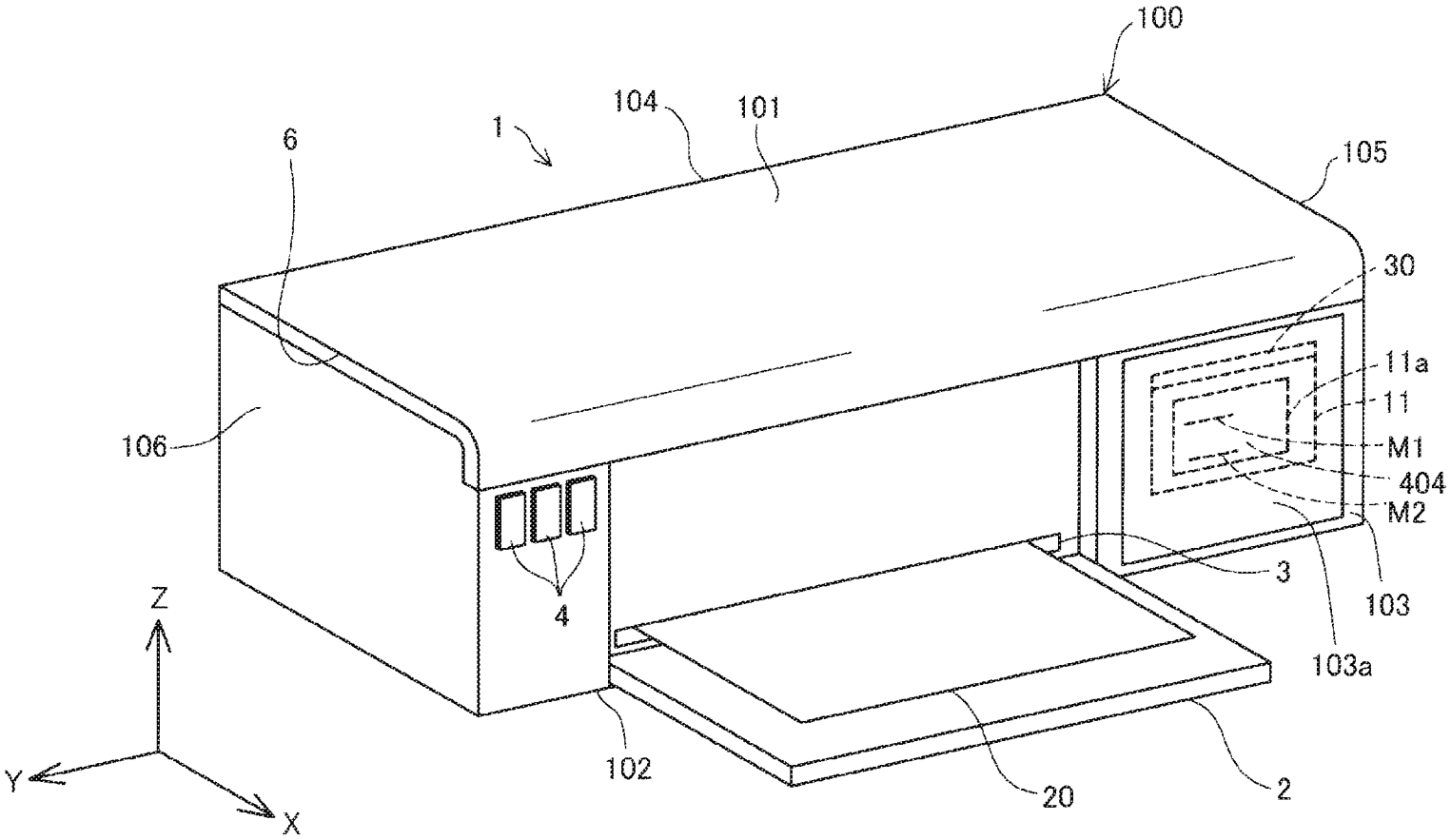
FIG. 1 is an external view showing a configuration of a liquid ejection apparatus.

FIG. 1 is an external view showing a configuration of a liquid ejection apparatus 1. FIG. 1 shows three spatial axes orthogonal to each other, namely, an X axis, a Y axis, and a Z axis. A direction along the X axis is referred to as an "X axis direction", a direction along the Y axis is referred to as a "Y axis direction", and a direction along the Z axis is referred to as a "Z axis direction" (an up-down direction). The liquid ejection apparatus 1 is installed on a plane parallel to the X axis direction and the Y axis direction (an XY plane). A −Z axis direction is the vertical downward direction, and a +Z axis direction is the vertical upward direction. The X axis, Y axis, and Z axis are added as necessary also to other drawings to be described below.

The liquid ejection apparatus 1 is an inkjet printer, and performs printing on a recording medium by ejecting ink serving as a liquid onto a recording medium 20 such as paper. The liquid ejection apparatus 1 of this embodiment is a printer that performs monochrome printing using black ink.

The liquid ejection apparatus 1 has an outer shell 100 that forms the outer surface. The outer shell 100 has a substantially rectangular parallelepiped shape, and has an upper face (first face, first wall) 101, a lower face (second face, second wall) 102, a front face (third face, third wall) 103, a rear face (fourth face, fourth wall) 104, a right side face (fifth face, fifth wall) 105, and a left side face (sixth face, sixth wall) 106. The upper face 101 and the lower face 102 oppose each other in the Z axis direction. The front face 103 opposes the rear face 104 in the X axis direction. The right side face 105 opposes the left side face 106 in the Y axis direction. The front face 103, the rear face 104, the right side face 105, and the left side face 106 are faces approximately vertical with respect to the installation surface of the liquid ejection apparatus 1. The upper face 101 and the lower face 102 are faces substantially horizontal with respect to the installation surface of the liquid ejection apparatus 1. Note that in this embodiment, "substantially vertical" and "substantially horizontal" encompass being "approximately vertical" and "approximately horizontal" as well as being "perfectly vertical" and "perfectly horizontal". That is, the faces 101 to 106 are not perfect flat faces, and allow for irregularities and the like, and it suffices for the faces 101 to 106 to appear "approximately vertical" or "approximately horizontal".

The liquid ejection apparatus 1 further has a front face cover 2, a discharge port 3, an operation unit 4, and an upper face cover 6. The front face cover 2 constitutes a portion of the front face 103, is axially supported at the lower end portion of the front face cover, and can be opened/closed by pivoting the upper end portion side. In FIG. 1, the front face cover 2 is in an open state. The discharge port 3 is exposed by opening the front face cover 2.

The discharge port 3 is a portion from which a recording medium 20 is discharged. Note that the recording medium 20 may be arranged in a tray provided on the rear face 104 side (not shown). Printing on the recording medium 20 is executed by conveying the recording medium 20 arranged on the tray into the outer shell 100 and ejecting ink onto the recording medium 20.

The operation unit 4 is a button that accepts various operations from a user. For example, the various operations include an operation of starting printing of the liquid ejection apparatus 1, a discharge operation of executing a discharge operation of discharging the liquid in the liquid tank to the outside.

The upper face cover 6 constitutes the upper face 101. The end portion of the upper face cover 6 on the rear face 104 side is axially supported, and the upper face cover 6 can be opened/closed by pivoting the front face 103 side. By opening the upper face cover 6, it is possible to check the internal state of the liquid ejection apparatus 1, perform a mounting/removing operation of the liquid tank 30 serving as the later-described liquid containing body, and inject ink into the liquid tank 30.

An apparatus-side window portion 103*a* is formed in a region of the front face 103 overlapping a home position of a carriage 19 in the Y axis direction (the direction of reciprocal movement of the carriage 19 to be described later). In this embodiment, the apparatus-side window portion 103*a* is arranged at a position different from that of the front face cover 2, and is arranged on the −Y axis direction side relative to the front face cover 2. An apparatus-side window portion 103*a* is provided in order for the user to check, from the outside, the front face (viewing face) 404 of the liquid tank 30 mounted on the carriage 19 located at the home position. In addition, signs M1 and M2 are provided on the front face 404. The apparatus-side window portion 103*a* may be a through hole that penetrates through the front face 103, or may be a transparent member. The signs M1 and M2 are elements for indicating references for the level of liquid contained in the liquid tank 30, and, in this embodiment, the sign M1 indicates a reference for an upper limit, and the sign M2 indicates a reference for a lower limit. The signs M1 and M2 will be described later in detail. Note that as long as the front face 404 of the liquid tank 30 at the home position can be viewed from the outside, the apparatus-side window portion 103*a* does not need to be provided in the front face 103. For example, the apparatus-side window portion 103*a* may be provided in the upper face 101. In this case, the user can view the front face 404 of the liquid tank 30 by viewing the apparatus-side window portion 103*a* from above and front on.

Figure 2:
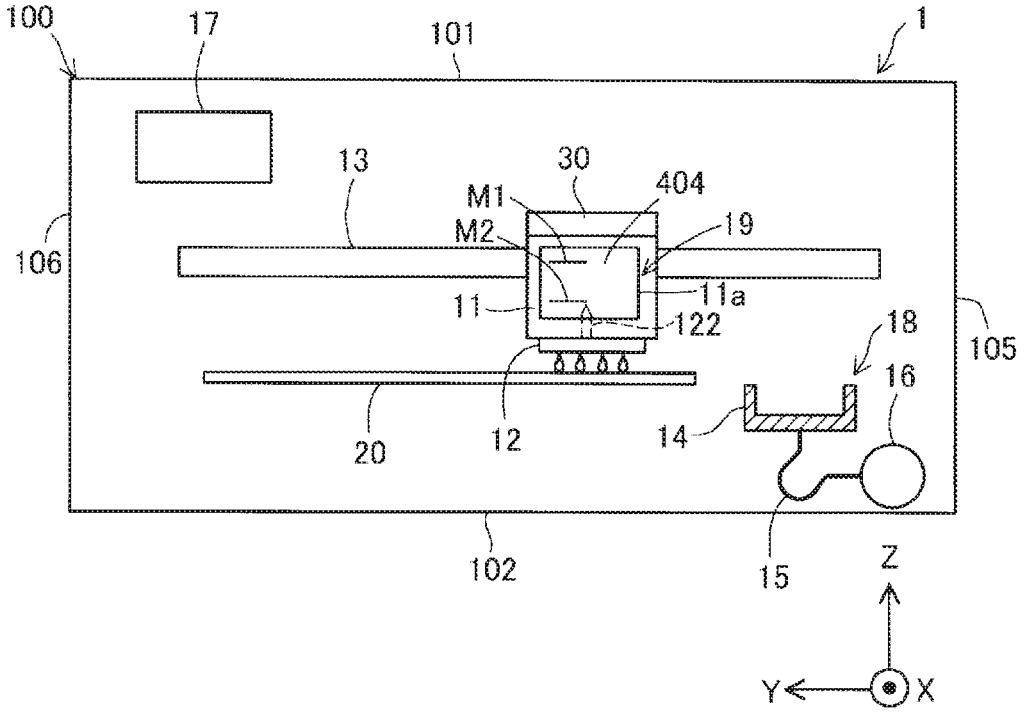
FIG. 2 is a schematic view showing an internal configuration of the liquid ejection apparatus.

FIG. 2 is a schematic diagram showing the internal configuration of the liquid ejection apparatus 1. The liquid ejection apparatus 1 has, inside the outer shell 100, a control unit 17, the carriage 19 provided with a liquid ejection head 12, and a liquid tank 30 that can be mounted on and removed from the carriage 19. The control unit 17 controls various operations (e.g., a printing operation) of the liquid ejection apparatus 1.

The carriage 19 has a mounting portion 11 arranged on the liquid ejection head 12. The mounting portion 11 has a recessed shape that is open in the +Z axis direction, for example, and forms a mounting space in which the liquid tank 30 is mounted. The liquid introduction needle portion 112 protruding in the +Z axis direction from a lower face that defines the mounting space protrudes into the mounting portion 11. The liquid introduction needle portion 122 is coupled to the liquid tank 30. The liquid introduction needle portion 122 is hollow, and a communication hole for communication with the inside of the liquid introduction needle portion 122 is formed on the leading end side thereof. Ink supplied from the liquid tank 30 via the communication hole of the liquid introduction needle portion 122 flows inside the liquid introduction needle portion 122. The liquid ejection head 12 is in communication with the liquid introduction needle portion 122, and ejects ink (in this embodiment, black ink) supplied from the liquid tank 30, from the nozzles onto a recording medium 20 (e.g., printing paper).

In addition, the mounting portion 11 has a mounting portion-side window portion 211*a* for the user to view the front face (viewing face) 404 including the signs M1 and M2. The mounting portion-side window portion 11*a* is provided at at least a position opposed to the sign M1 of the liquid tank 30. For example, the mounting portion-side window portion 11*a* may be a through hole that penetrates through a wall that forms the mounting portion 11, or may be a transparent member. If the carriage 19 is located at the home position, the user can view the front face (viewing face) 404 with the signs M1 and M2 via the apparatus-side window portion 103*a* (FIG. 1) and the mounting portion-side window portion 11*a*.

The carriage 19 equipped with the liquid ejection head 12 is driven by a driving mechanism, which is not illustrated in the drawings, and repeatedly performs reciprocal movement above the recording medium 20 while being guided by a guide rail 13 extending in the Y axis direction. In addition, the liquid ejection apparatus 1 has a conveyance mechanism for conveying the recording medium 20 toward the discharge port 3 (FIG. 1). An image or the like is printed onto the recording medium 20 by ejecting liquid from the liquid ejection head 12 in accordance with the movement of the carriage 19 reciprocally moving, and the movement of the recording medium 20 being conveyed.

The liquid tank 30 contains ink to be supplied to the liquid ejection head 12. The ink (black ink) that is contained in the present embodiment is ink obtained by dissolving pigment particles in a solvent, for example. The liquid tank 30 is detachably coupled to the liquid introduction needle portion 122. Due to the liquid tank 30 being coupled to the liquid introduction needle portion 122, the ink in the liquid tank 30 can flow in the liquid introduction needle portion 122.

The liquid ejection apparatus 1 further has a discharge portion 18 that executes an operation (discharging operation) of periodically sucking out a fluid (e.g., liquid (ink) or air) from the liquid ejection head 12.

The discharge portion 18 is arranged inside the outer shell 100. The discharge portion 18 includes a cap 14, a suction tube 15, and a suction pump 16. When the liquid ejection apparatus 1 is not performing a printing operation, the carriage 19 is arranged at the home position, which is a position that is outside of a movement region for a printing operation.

The cap 14 is a member arranged below the home position and shaped like a bottomed box. The cap 14 can move in the Z axis direction (up-down direction) due to an elevation mechanism (not shown). The cap 14 is pressed against the lower face of the liquid ejection head 12 by being moved upward. Accordingly, the cap 14 forms a closed space such that nozzle holes formed in the lower face of the liquid ejection head 12 are covered (closed space state). It is possible to suppress the drying of ink in the liquid ejection head 12 (nozzles) by using this closed space.

The suction tube 15 allows the cap 14 (specifically, a through hole formed in the bottom face of the cap 14) and the suction pump 16 to be in communication with each other. The suction pump 16 sucks fluid (liquid (ink) or air) in the liquid ejection head 12 or the liquid tank 30 via the suction tube 15 by being driven in the closed space state. Initial filling of the liquid ejection head 12 with ink can be performed in this manner, and deteriorated ink (dried and thickened ink) in the liquid ejection head 12 can be sucked out.

Next, a configuration of a liquid tank 30 will be described.

Figure 3:
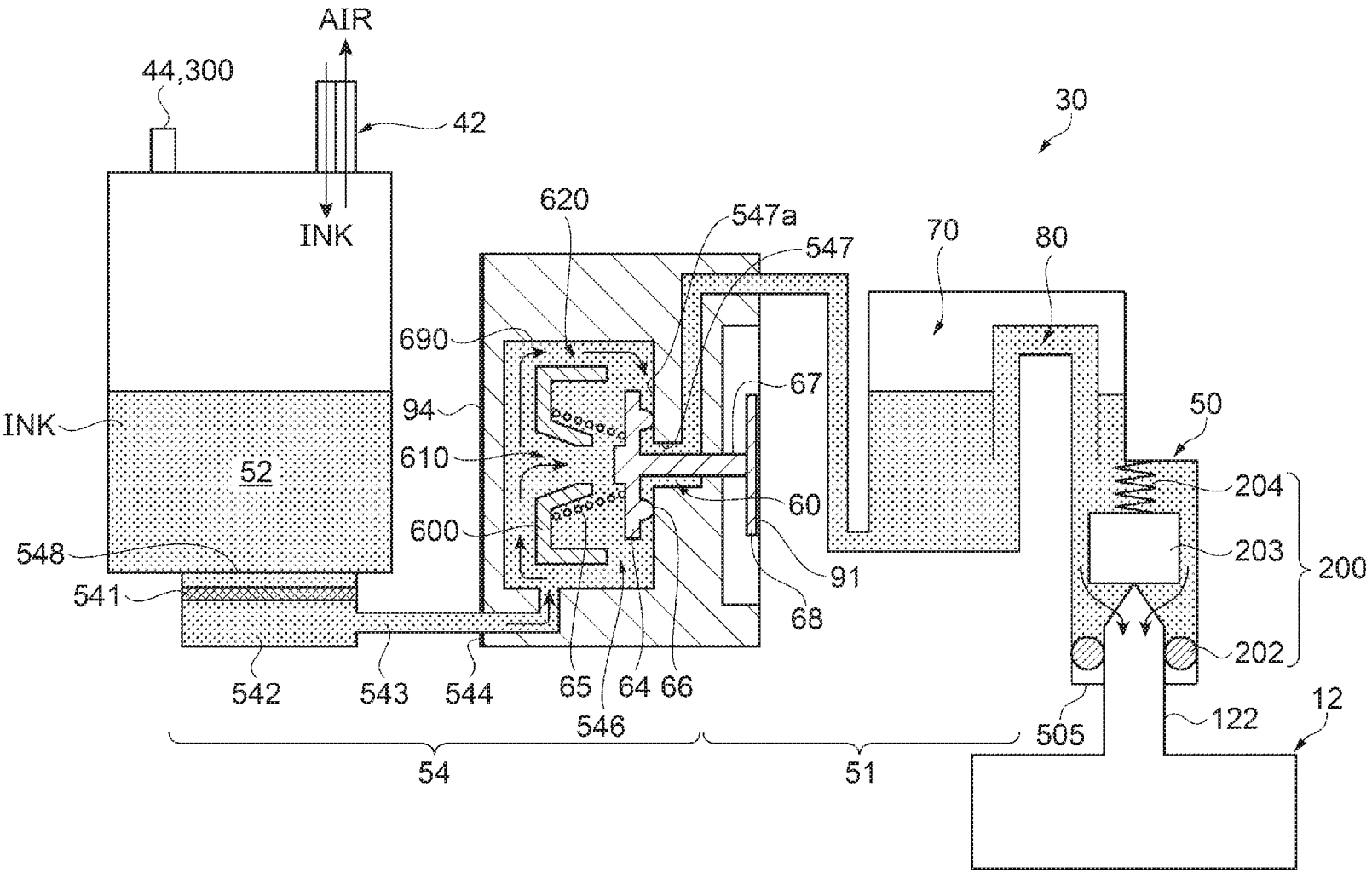
FIG. 3 is a conceptual diagram for illustrating mainly a flow path configuration of a liquid tank.

FIG. 3 is a conceptual drawing for illustrating mainly a flow path configuration of the liquid tank 30. Before the detailed configuration of the liquid tank 30 is described, an overall description of the liquid tank 30 will be given below with reference to FIG. 3. Also, the terms "upstream" and "downstream" used in the following description are based on the flow direction of the ink from the liquid tank 30 to the liquid ejection head 12. Note that in FIG. 3, regions in which ink is present are denoted by dots.

As the flow path along which the ink flows, the liquid tank 30 includes, in order starting from upstream, a second liquid chamber 52 (liquid containing chamber), a coupling flow path 54, a first liquid chamber 51, a liquid communication flow path 80, and a liquid supply portion 50. Also, the liquid tank 30 includes an air communication flow path 70 as a flow path along which air flows.

The ink can be injected into the second liquid chamber 52 from the outside through the liquid injection portion 42 (liquid injection port). Also, the second liquid chamber 52 is in communication with the atmospheric air due to the atmospheric air communication portion 300 including the atmospheric air release portion 44, which is at one end thereof. The second liquid chamber 52 is in communication with the first liquid chamber 51 and is configured to contain ink that is to be supplied to the first liquid chamber 51, that is, ink that has yet to be contained in the first liquid chamber 51.

The coupling flow path 54 couples the first liquid chamber 51 and the second liquid chamber 52, and is configured to be able to supply the liquid in the second liquid chamber 52 to the first liquid chamber 51. The coupling flow path includes, in order starting from upstream: a filter chamber 542, a defoaming portion 543, an intermediate flow path 544, and a valve arrangement chamber 546. The filter chamber 542 is formed so as to be located below the second liquid chamber 52 in the state of being mounted on the liquid tank 30. The filter chamber 542 is coupled to the second liquid chamber 52. Specifically, the filter chamber 542 has an influx opening 548 (liquid outflow port), which is an opening formed in the bottom face of the second liquid chamber 52. That is, the influx opening 548 is coupled to the second liquid chamber 52. A filter member 541 that divides the filter chamber 542 into downstream and upstream is arranged in the filter chamber 542, and the filter chamber 542 is coupled to the second liquid chamber 52 via the filter member 541. The filter member 541 catches foreign matter and air bubbles in the ink flowing from upstream to downstream, and suppresses downstream flow of the foreign matter and air bubbles. Accordingly, since it is possible to reduce the likelihood that the foreign matter and air bubbles will flow into the liquid ejection head 12, it is possible to reduce the occurrence of clogging of the liquid ejection head 12 and an ink ejection defect. Also, due to the filter chamber 542 being arranged upstream of the valve arrangement chamber 546, the likelihood that the foreign matter or air bubbles will flow into the valve arrangement chamber 546. Accordingly, it is possible to reduce the likelihood that an inconvenience will occur during an operation of opening/closing the later-described valve mechanism 60 due to foreign matter or air bubbles. The filter member 541 is a filter made of plate-shaped stainless steel, and has multiple minute holes that allow the passage of ink and can suppress the passage of foreign matter and air bubbles. Note that the filter member 541 may be formed by another material, as long as it allows the passage of ink and suppresses the passage of foreign matter and air bubbles.

The defoaming portion 542 is provided upstream of the valve mechanism 60 serving as a negative voltage generation mechanism, and downstream of the filter member 541 and the filter chamber 542. The defoaming portion 543 is a space that eliminates air bubbles included in the ink. Note that the detailed mode of the defoaming portion 543 will be described later.

The intermediate flow path 544 is the flow path that couples the filter chamber 542 and the first liquid chamber 51, and is provided downstream of the defoaming portion 543. The valve arrangement chamber 546 includes an inlet opening portion 547 coupled to the first liquid chamber 51. That is, the inlet opening portion 547 forms one end (downstream end) of the coupling flow path 54. The inlet opening portion 547 forms a through hole in which the cross section of the flow path has a circular shape.

Part of the valve mechanism 60 for opening/closing the inlet opening portion 547 and controlling the flowing of the ink from the second liquid chamber 52 to the first liquid chamber 51 is arranged in the valve arrangement chamber 546. Due to the valve mechanism 60 entering the open state, the second liquid chamber 52 and the first liquid chamber 51 are in communication, and the ink in the second liquid chamber 52 flows into the first liquid chamber 51. Also, due to the valve mechanism 60 entering the closed state, the second liquid chamber 52 and the first liquid chamber 51 enter a non-communicating state.

Inside of an outer wall 690 forming the valve mechanism 60, the valve mechanism 60 includes, in order starting from upstream of the flow of the ink: a flow path member 600; a biasing member 65; a valve body 64; and a rod 67. The flow path member 600 is arranged inside of the biasing member 65 and includes a first flow path 610 inside of which the ink can pass. Also, the outer wall 690 and the biasing member 65 form a second flow path 620, in which ink can flow between the outer wall 690 and the biasing member 65. The valve body 64 is a circular plate-shaped member and is arranged in the valve arrangement chamber 546. The valve body 64 opposes the inlet opening portion 547, sandwiching a seal portion 66 with a circular ring-shaped protrusion. The seal portion 66 is arranged on the peripheral edge portion of the inlet opening portion 547 so as to surround the inlet opening portion 547. Due to the seal portion 66 of the valve body 64 coming into contact with an opening peripheral face 547*a* of the inlet opening portion 547, the valve arrangement chamber 546 and the first liquid chamber 51 enter the non-communicating state. Due to the seal portion 66 of the valve body 64 moving away from the opening peripheral face 547*a* of the inlet opening portion 547, the valve arrangement chamber 546 and the first liquid chamber 51 enter the communicating state. The rod 67 is a rod-shaped member with one end coupled to the valve body 64 and another end being able to come into contact with a pressure receiving plate 68. The rod 67 is inserted into the inlet opening portion 547. The pressure receiving plate 68 is a circular plate-shaped member. The first film 91 is arranged so as to cover and be able to come into contact with the pressure receiving plate 68.

The biasing member 65 is a compressed coil spring arranged in the valve arrangement chamber 546. The biasing member 65 biases the pressure receiving plate 68 toward the first film 91. When the interior of the first liquid chamber 51 reaches a negative pressure of a predetermined magnitude due to the ink in the first liquid chamber 51 being consumed by being supplied by the liquid ejection head 12, the valve body 64 is biased in the direction of moving away from the inlet opening portion 547, against the biasing force of the biasing member 65. Accordingly, due to the seal portion 66 of valve body 64 moving away from the opening peripheral face 547*a* of the inlet opening portion 547, the valve mechanism 60 enters an open state and the valve arrangement chamber 546 and the first liquid chamber 51 enter a state of being in communication with each other. In the state of being in communication with each other, when ink is supplied from the second liquid chamber 52 to the first liquid chamber 51 and the pressure in the first liquid chamber 51 rises by a certain degree (e.g., when it becomes greater than a predetermined negative pressure), the seal portion 66 of the valve body 64 moves toward the opening peripheral face 547*a* of the inlet opening portion 547 and comes into contact with the opening peripheral face 547*a*. Accordingly, the valve mechanism 60 enters a closed state and the valve arrangement chamber 546 and the first liquid chamber 51 enter a state of not being in communication. As described above, the valve mechanism 60 enters the open state when at least the interior of the first liquid chamber 51 reaches a negative pressure of a predetermined magnitude, and therefore the pressure in the first liquid chamber 51 can be made stable.

The first liquid chamber 51 can store ink to be supplied to the liquid supply portion 50. The liquid communication flow path 80 couples the first liquid chamber 51 and the liquid supply portion 50 and is configured to supply the ink in the first liquid chamber 51 to the liquid supply portion 50. An air communication flow path 70 couples the first liquid chamber 51 and the liquid supply portion 50, and allows air to flow between the first liquid chamber 51 and the liquid supply portion 50.

The liquid supply unit 50 has a liquid supply port 505 at its downstream end. The liquid supply port 505 accepts the liquid introduction needle portion 122. The liquid supply portion 50 is detachably coupled to the liquid introduction needle portion 122 of the liquid ejection head 12. Specifically, the liquid supply portion 50 is coupled to the liquid introduction needle portion 122 due to the liquid introduction needle portion 122 being inserted into the liquid supply portion 50 via the liquid supply port 505 of the liquid supply portion 50. Accordingly, ink can be supplied from the liquid supply portion 50 to the liquid introduction needle portion 122.

A supply portion valve mechanism 200 for opening and closing the flow path of the liquid supply portion 50 is arranged inside of the liquid supply portion 50. The supply portion valve mechanism 200 includes, in order starting from downstream: a valve seat 202, a valve body 203, and a spring 204.

The valve seat 202 is a substantially circular ring-shaped member. The valve seat 202 is constituted by an elastic member such as rubber or elastomer, for example. The valve seat 202 is press-fit into the liquid supply portion 50. The valve body 202 is a substantially circular column-shaped member. The valve body 203 closes a hole (valve hole) formed in the valve seat 202 in a state prior to when the liquid tank 30 is equipped on the carriage 19 (pre-mounted state). The spring 204 is a compressed coil spring. The spring 204 biases the valve body 203 in the direction toward the valve seat 202. In the mounted state of the liquid tank 30, in which the liquid tank 30 is equipped on the carriage 19 and the liquid supply portion 50 is coupled to the liquid introduction needle portion 122, the valve body 203 moves in the direction of moving away from the valve seat 202 due to the liquid introduction needle portion 22 pressing the valve body 203 upstream. Accordingly, the supply portion valve mechanism 200 enters the open state and ink can be supplied from the liquid supply portion 50 to the liquid introduction needle portion 122.

As described above, in the liquid tank 30 of the present embodiment, a valve mechanism 60 is provided between the second liquid chamber 52 and the liquid supply port 505. Also, if the flow path through which the second liquid chamber 52 and the valve mechanism 60 are in communication is the upstream liquid communication path and the flow path through which the valve mechanism 60 and the liquid supply port 505 are in communication is the downstream liquid communication path, the ink enters a positive pressure state (atmospheric pressure) in the upstream liquid communication path, and the ink enters a negative pressure state in the downstream liquid communication path. Also, the defoaming portion 543 is arranged in a portion of the upstream liquid communication path.

Air bubbles expand in the negative pressure environment of the downstream liquid communication path, whereas air bubbles can be eliminated due to the air bubbles being dissolved in the ink in the positive pressure environment of the upstream liquid communication path. Accordingly, if minute air bubbles that could not be trapped by the filter member 541 flow, the air bubbles can be eliminated in the defoaming portion 543 arranged in the positive-pressure environment.

Next, a detailed configuration of a liquid tank 30 will be described.

Figure 4:
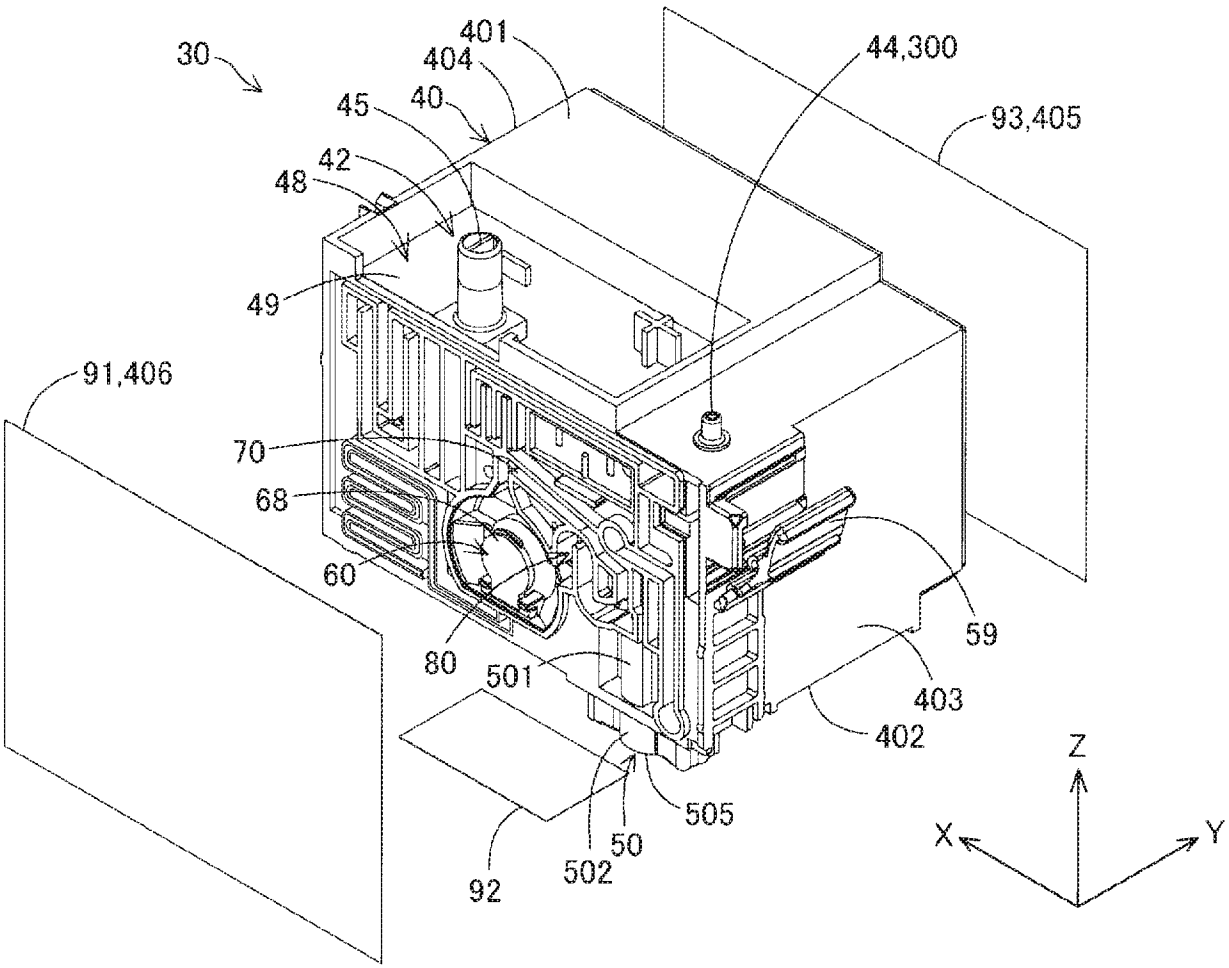
FIG. 4 is a perspective view showing part of the liquid tank.
Figure 5:
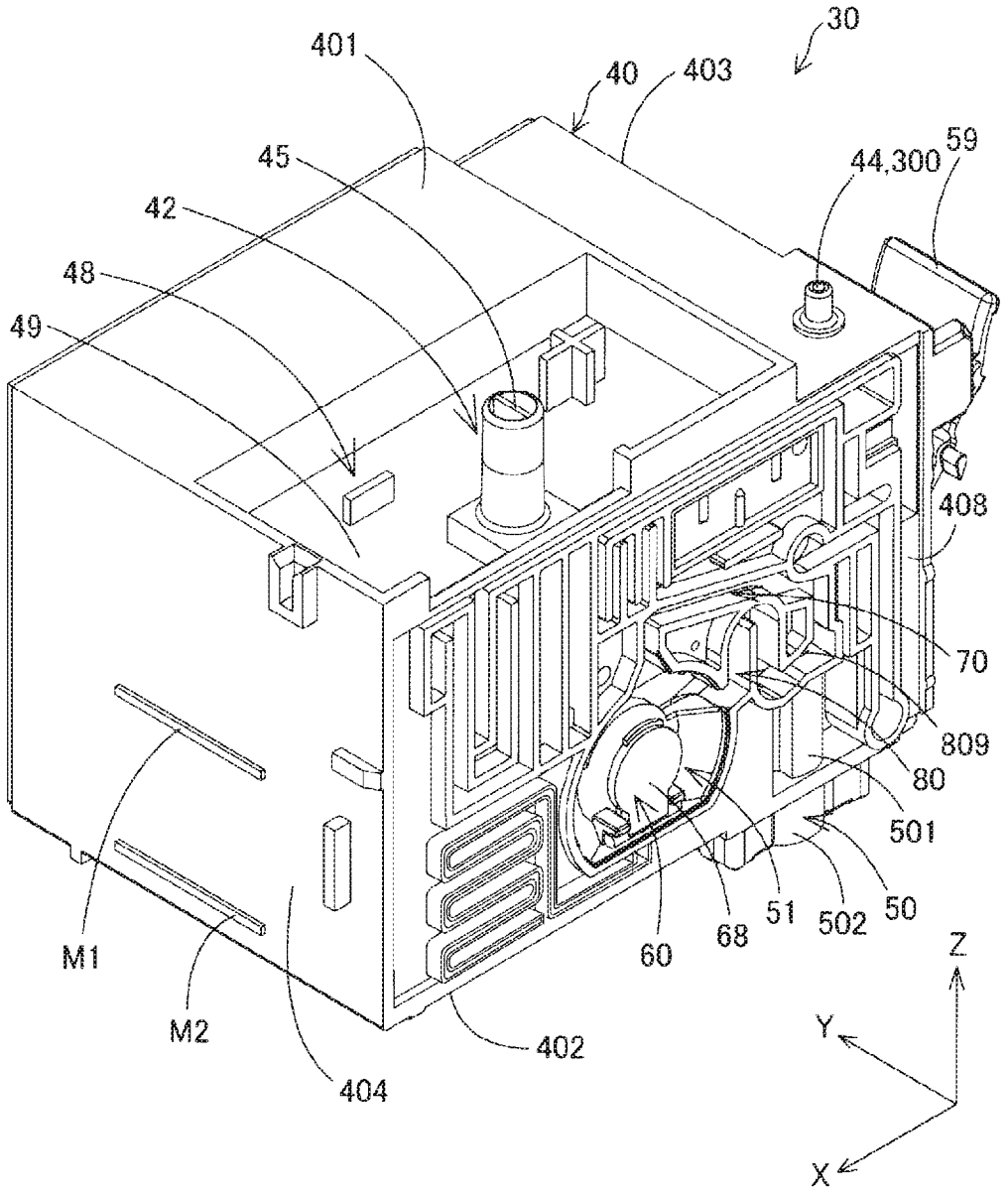
FIG. 5 is a first perspective view of a tank main body.
Figure 6:
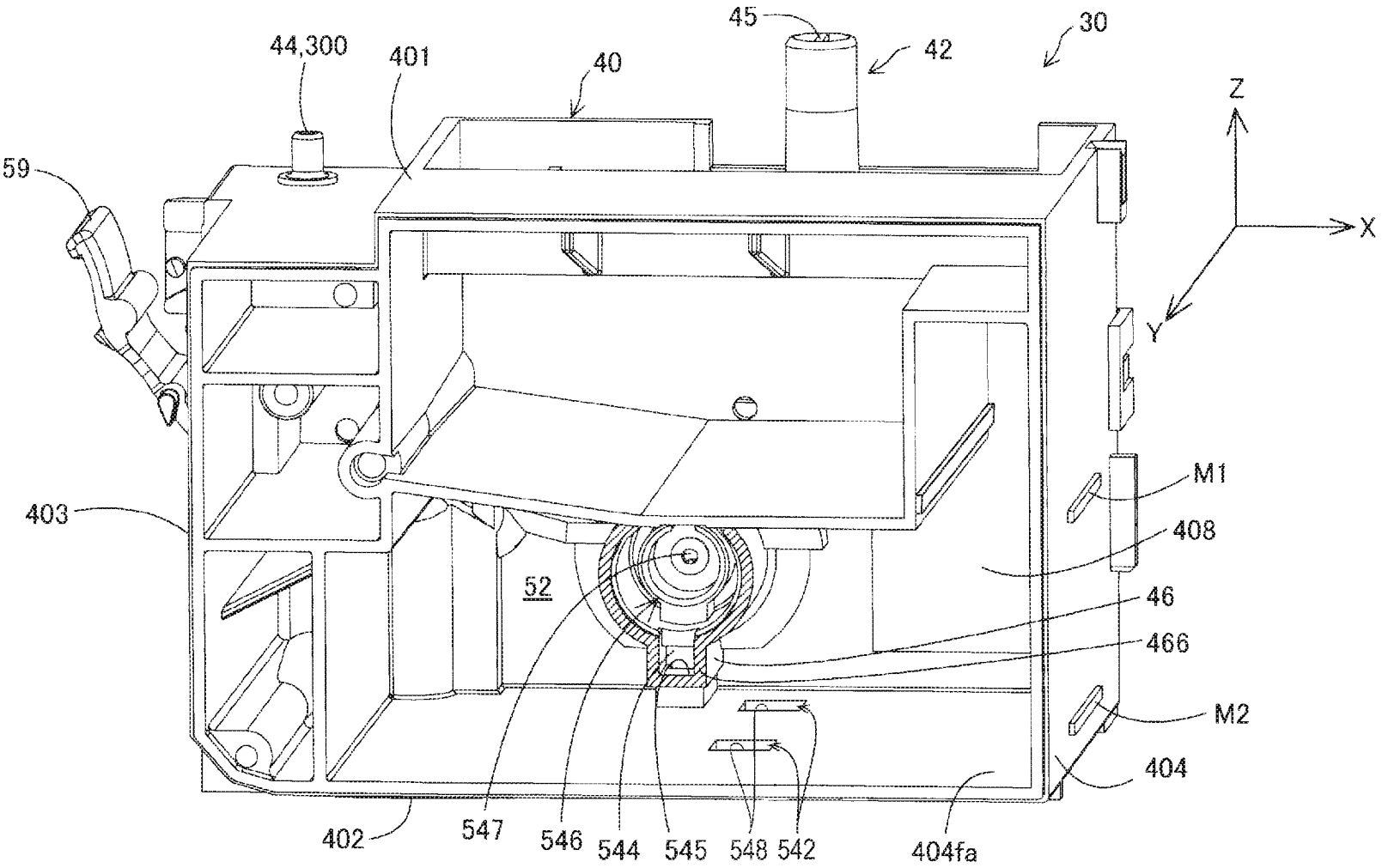
FIG. 6 is a second perspective view of the tank main body.
Figure 7:
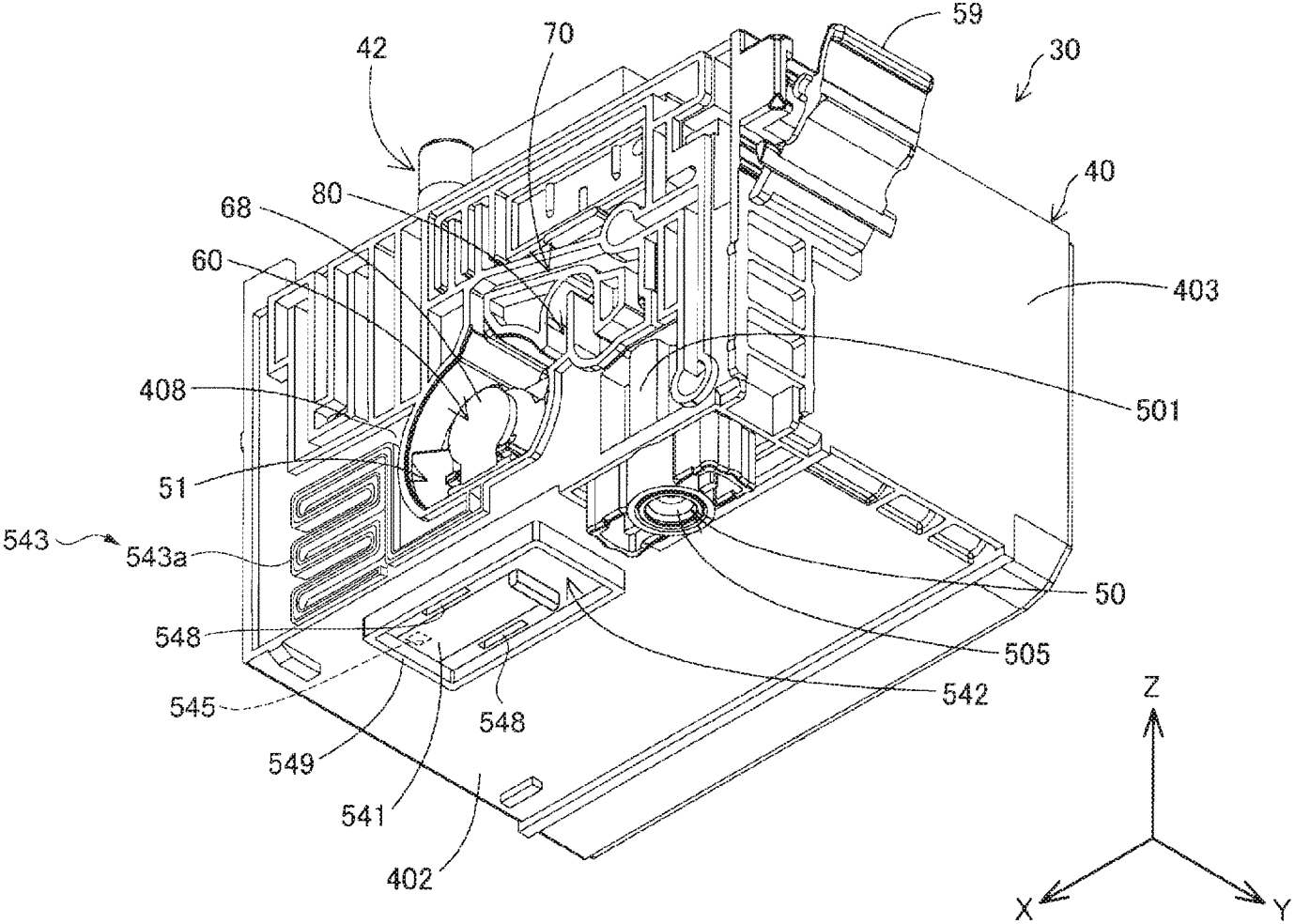
FIG. 7 is a third perspective view of the tank main body.
Figure 8:
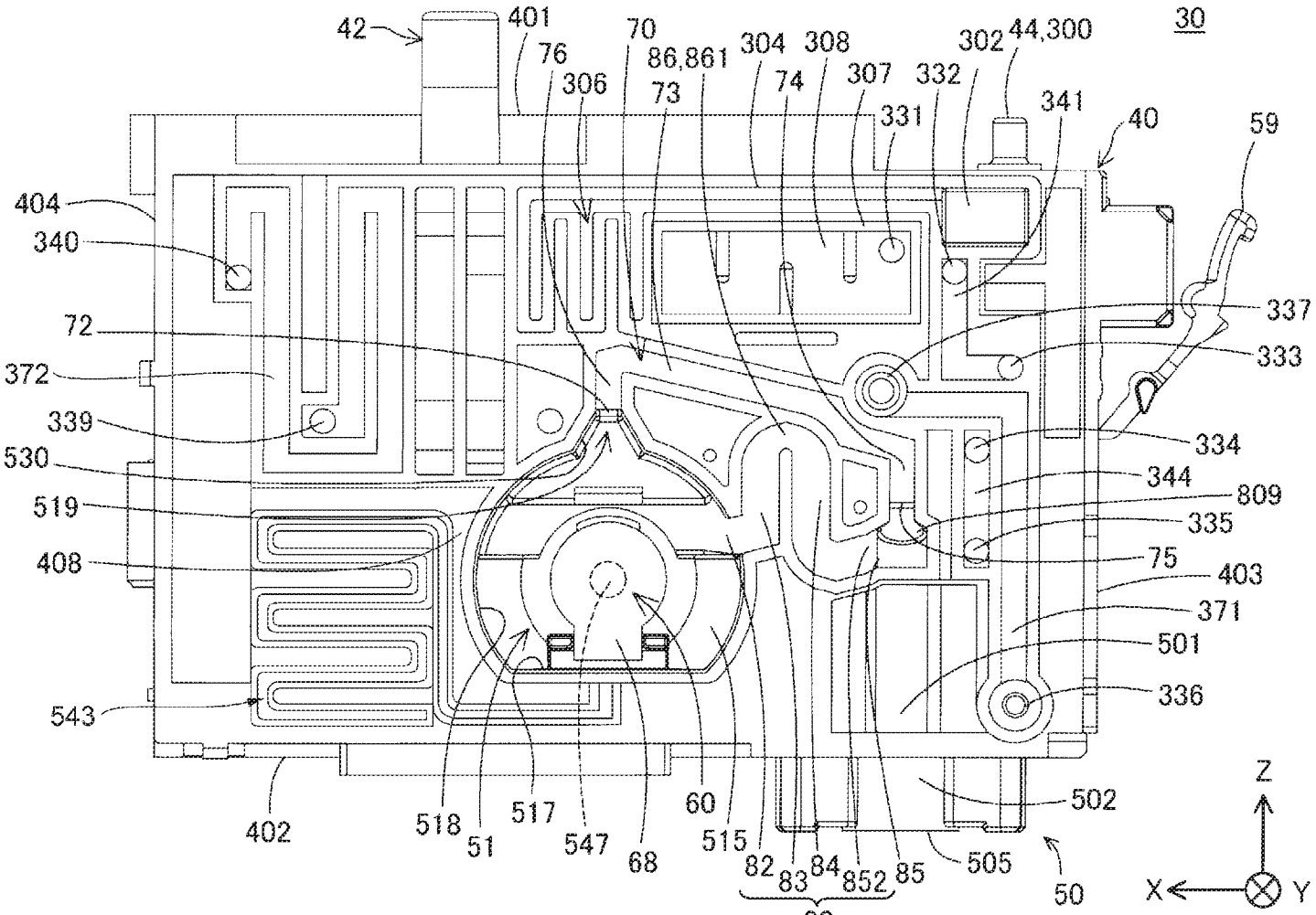
FIG. 8 is a first view of the tank main body from a −Y axis direction side.
Figure 9:
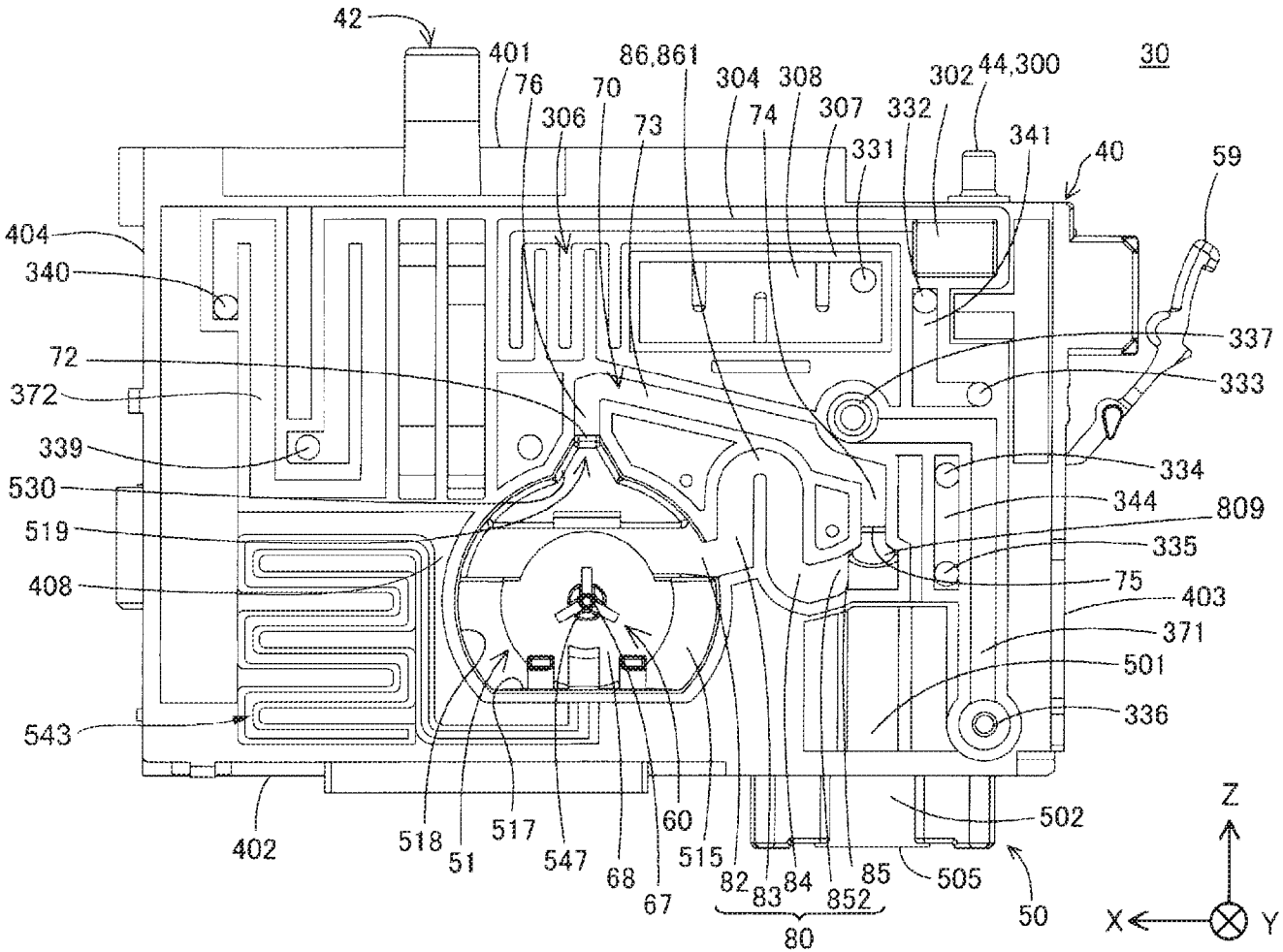
FIG. 9 is a second view of the tank main body from a −Y axis direction side.
Figure 10:
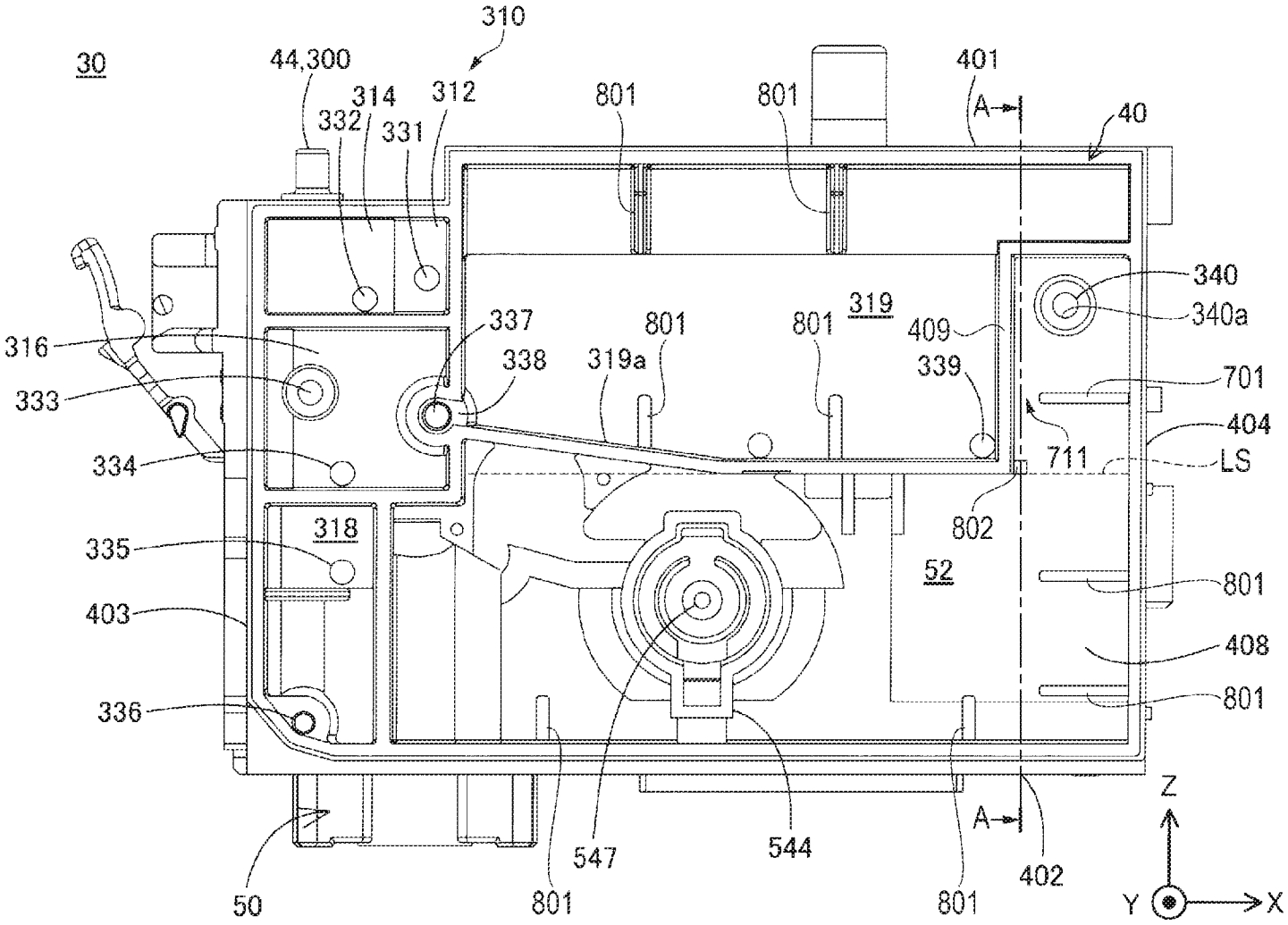
FIG. 10 is a view of the tank main body from the +Y axis side.

FIG. 4 is a partial exploded perspective view of the liquid tank 30. FIG. 5 is a first perspective view of the tank main body 40. FIG. 6 is a second perspective view of the tank main body 40. FIG. 7 is a third perspective view of the tank main body 40. FIG. 8 is a first view of the tank main body 40 from the −Y axis direction side. FIG. 9 is a second view of the tank main body 40 from the −Y axis direction side. FIG. 10 is a view of the tank main body 40 from the +Y axis direction side. A valve mechanism 60 arranged in the tank main body 40 is also illustrated in FIGS. 5, 7, and 8. The rod 67 of the valve mechanism 60 is illustrated in FIG. 9.

As shown in FIG. 4, the liquid tank 30 includes: a tank main body 40; a first film 91; a second film 92; and a third film 93. The liquid tank 30 has an approximately rectangular parallelepiped shape. In the liquid tank 30, the X axis direction is the length direction, the Y axis direction is the width direction, and the Z axis direction is the height direction.

The liquid tank 30 includes: an upper face (upper wall) 401; a lower face (bottom wall) 402; a front face (first wall) 404; a rear face (second wall) 403; a right side face (third wall) 406; and a left side face (fourth wall) 405. In the mounted state (use state) in which the liquid tank 30 is mounted on the carriage 19, the upper face 401 and the lower face 402 oppose each other in the Z axis direction. In the mounted state, the rear face 403 and the front face 404 oppose each other in the X axis direction. In the mounted state, the left side face 405 and the right side face 406 oppose each other in the Y axis direction. The left side face 405 is formed by the third film 93. The right side face 406 is formed by the first film 91. The upper face 401, the lower face 402, the rear face 403, and the front face 404 are formed by the tank main body 40. The rear face 403, the front face 404, the left side face 405, and the right side face 406 are faces substantially vertical with respect to the installation surface of the liquid ejection apparatus 1. The upper face 404 and the lower face 102 are faces substantially horizontal with respect to the installation surface of the liquid ejection apparatus 1. That is, the faces 401 to 406 are not perfect flat faces, and allow for irregularities and the like, and it suffices for the faces 401 to 406 to appear "approximately vertical" or "approximately horizontal".

Note that although the left side face (fourth wall) 405 is formed by the third film 93, there is no limitation to this, and for example, the left side face 405 may be a plate-shaped resin member or the like.

Also, the front face 404 forms a viewing portion (viewing face) according to which it is possible to view the level of the ink (amount of ink) in the liquid tank 30 (specifically, the second liquid chamber 52) from the outside. For example, the viewing portion is formed by a transparent or semi-transparent member. Accordingly, the amount of ink stored in the liquid tank 30 can easily be checked via the viewing portion. Furthermore, signs (e.g., gradations or marks) corresponding to references (e.g., the upper limit and lower limit) of the level (liquid surface) of the ink may also be provided on the front face 404 (viewing portion). As shown in FIG. 5, in the present embodiment, the upper limit mark M1, which is the mark corresponding to the upper limit, and the lower limit mark M2, which is the mark corresponding to the lower limit, are provided on the front face 404. For example, when the ink is to be injected through the liquid injection portion 42, if the liquid surface has reached the upper limit sign M1, the user stops the injection of the liquid. Also, for example, when the liquid surface in the liquid tank 30 (specifically, the second liquid chamber 52) reaches the lower limit mark M2, the user injects the ink into the second liquid chamber 52 through the liquid injection portion 42.

A lever 59 for mounting and removing the liquid tank 30 to and from the mounting portion 11 (FIG. 2) of the carriage 19 is provided on the rear face 403. In the mounted state, the lever 59 suppresses a case in which the liquid tank 30 comes off of the mounting portion 11 due to engaging with the mounting portion 11. The mounting portion 11 can elastically deform. The user presses the lever 59 to the rear face 403, thereby causing the lever 59 to elastically deform toward the rear face 403 and canceling the engagement with the mounting portion 11. The liquid tank 30 can be removed from the mounting portion 11 by canceling the engagement.

The tank main body 40 has an approximately cuboid shape, and for example, is formed by a synthetic resin such as polypropylene or polystyrene. The first film 91, the second film 92, and the third film 93 are airtightly adhered to different portions of the tank main body 40, thereby defining and forming a flow path through which ink and air in the liquid tank 30 flow, along with the tank main body 40.

The tank main body 40 (FIG. 6) has a recessed shape with an opening formed on the +Y axis direction side. The tank main body 40 has one side wall 408 that forms the bottom portion of the tank main body 40 with the recessed shape. The one side wall 408 is a wall that defines the first liquid chamber 51 and the second liquid chamber 52.

The one side wall 408 is approximately parallel to the X axis direction and the Z axis direction. As shown in FIG. 5, the first liquid chamber 51, the liquid communication flow path 80, and the air communication flow path 70 are formed on one side (the −Y axis direction side) of the one side wall 408. Also, as shown in FIG. 6, the second liquid chamber 52 is formed on another side (+Y axis direction side) that is opposite to the one side of the one side wall 408. Accordingly, since the first liquid chamber 51, the liquid communication flow path 80, the air communication flow path 70, and the second liquid chamber 52 can be arranged by efficiently using the space in the liquid tank 30, it is possible to suppress a size increase of the liquid tank 30.

As shown in FIGS. 4 and 8, the groove portion that defines and forms the air communication flow path 70 and the liquid communication flow path 80 and the recessed portion that forms the first liquid chamber 51 are formed in the one side wall 408. Due to the first film 91 being airtightly adhered to the end face on the −Y axis direction side of the one side wall 408, the first liquid chamber 51, the air communication flow path 70, and the liquid communication flow path 80 are defined and formed. Also, the second liquid chamber 52 is defined and formed due to the third film 93 being airtightly adhered to the +Y axis direction-side end face of the tank main body 40 that opposes the one side wall 408.

The tank main body 40 (FIG. 4) further includes the liquid injection portion 42. The liquid insertion portion 42 extends in the +Z axis direction from the bottom face 49 of the corner portion 48 at which the upper face 401, the front face 404, and the right side face 406 intersect. The liquid insertion portion 42 is a tube-shaped member and forms the first flow path and the second flow path. A partitioning wall 45 is arranged inside the liquid insertion portion 42. The first flow path and the second flow path are partitioned by the partitioning wall 45. At the time of injecting the liquid, the first flow path functions as a liquid injection path along which the liquid flows into the second liquid chamber 52, and the second flow path functions as an air discharge path for discharging the air from the second liquid chamber 52. A cap (not shown) is mounted on the liquid injection portion 42 when the liquid in the liquid tank 30 is used. Also, an atmospheric air release portion 44, which is one end portion of the atmospheric air communication portion 300, is formed in the upper portion of the tank main body 40. The atmospheric air communication portion 300 has a thin groove-shaped flow path, and a buffer chamber that can contain ink when ink flows backward. The other end portion of the atmospheric air communication portion 300 is coupled to the second liquid chamber 52. Accordingly, when using the liquid tank 30, the second liquid chamber 52 is in communication with the atmospheric air. The atmospheric air communication portion 300 will be described in detail later.

As shown in FIG. 6, the second liquid chamber 52 has a second liquid chamber bottom face 404*fa* that forms the bottom face in the mounted state. The second liquid chamber bottom face 404*fa* is the inner surface of the lower face 402. In the mounted state, an influx opening 548 that penetrates in the vertical downward direction (−Z axis direction) in the closed state is formed in the second liquid chamber bottom face 404*fa*. The influx opening 548 is the upstream end of the filter chamber 542 formed in the lower face 402. The influx opening 548 is arranged near the filter member 541.

The filter chamber 542 (FIG. 7) is defined and formed by a frame-shaped member 549 that protrudes from the lower face 402, and by the second film 92 (FIG. 4) that is airtightly adhered to the lower end face of the frame-shaped member 549. The filter chamber 542 is located below (in the −Z axis direction) the second liquid chamber 52 in the mounted state. The filter member 541 is arranged inside of the frame-shaped member 549. The filter member 541 is plate-shaped and is orthogonal to the vertical downward direction (−Z axis direction) in the mounted state.

The filter member 541 is arranged below the influx opening 548 in the mounted state. Thus, even if the air bubbles stick to the filter member 541, for example, the stuck air bubbles can be guided to the second liquid chamber 52 via the influx opening 548 by causing swinging due to reciprocal movement of the carriage 19. Accordingly, it is possible to reduce the likelihood that air bubbles will flow out to the first liquid chamber 51 and the liquid supply portion 50.

The ink in the second liquid chamber 52 flows in the −Z axis direction, and thereby passes through the influx opening 548 and the filter member 541, and the ink that has passed through the filter member 541 flows in the +Z axis direction via the communication opening 545. The ink that has passed through the communication opening 545 flows into the defoaming portion 543.

The defoaming portion 543 of the present embodiment has a configuration that includes a winding path 543*a*. As shown in FIG. 7, the winding path 543*a* is a flow path that is long and narrow and winds in order to make the flow path length from the communication opening 545 to the intermediate flow path 544 longer. Accordingly, for example, even when minute air bubbles flow, the air bubbles can be dissolved in the ink in the winding path 543*a*. Also, the ink that has passed through the winding path 543*a* flows into the intermediate flow path 544.

The intermediate flow path 544 and the valve arrangement chamber 546 (FIG. 6) are defined and formed by the one side wall 408, the flow path wall 46 that rises from the one side wall 408 toward the opening (+Y axis direction) of the recessed tank main body 40, and a film 94 (see FIG. 3) that is airtightly adhered to the end face 466 on the +Y axis direction side of the flow path wall 46. Note that in FIG. 6, the end face 466 to which the film 94 is to be attached is indicated with single hatching.

The intermediate flow path 544 (FIG. 6) is a flow path that extends in a direction along the gravity direction in the mounted state. The direction along the weight direction is a direction that is approximately perpendicular to the horizontal direction, and is a direction that forms an angle of 80 degrees or more and 100 degrees or less with respect to the horizontal direction. In the mounted state, the intermediate flow path 544 extends in the direction along the gravity direction, and thus the flow path length of the intermediate flow path 544 can be shortened compared to the case of extending in the direction intersecting the gravity direction.

The valve arrangement chamber 546 has an approximately circular shape when the tank main body 40 is viewed from the +Y axis direction side. An inlet opening portion 547 is formed in the valve arrangement chamber 546. Specifically, the inlet opening portion 547 is a through hole that penetrates through the one side wall 408.

The first liquid chamber 51 (FIG. 8) is formed by a recessed portion that is formed in the one side wall 408 and is open in the horizontal direction (in the present embodiment, in the −Y axis direction), and the first film 91 (FIG. 4) that is airtightly adhered to the −Y axis direction side end face of the recessed portion. The first liquid chamber 51 has a larger dimension in the Y axis direction than the air communication flow path 70 does. That is, the first liquid chamber 51 is deeper than the air communication flow path 70 is. The volume (maximum volume) of the first liquid chamber 51 is smaller than that (maximum volume) of the second liquid chamber 52. The first liquid chamber 51 includes: a side wall 515 that opposes the first film 91, a bottom wall 517 that is located on the vertical downward direction side in the mounted state, a circular arc-shaped circumferential wall 518 that extends from the bottom wall 517 in the vertical upward direction in the mounted state, and an uppermost portion 519. The inlet opening portion 547 is formed in the side wall 515. The peripheral wall 518 has a portion that opposes the bottom wall 517. The uppermost portion 518 is a portion that protrudes upward from the peak portion of the peripheral wall 518, and in the mounted state, is arranged at the highest position in the first liquid chamber 51.

The uppermost portion 519 is a space that has a certain volume. Also, the uppermost portion 519 may have a tapered portion 530 with a flow path cross-sectional area that decreases in size toward the top, that is, toward an air-side coupling portion 72 side to which the air communication flow path 70 is coupled. In the present embodiment, the uppermost portion 519 has a tapered portion 530. If the uppermost portion 519 has the tapered portion 530, the volume of the uppermost portion 519 can be increased while suppressing an increase in the size of the first liquid chamber 51 compared to the case of not having the tapered portion 530. Accordingly, the amount of air that can be stored in the uppermost portion 519 (air storage amount) can be increased. Also, since the volume of the uppermost portion 519 can be increased, it is possible to suppress a case in which ink or air bubbles flow from the first liquid chamber 51 into the air communication flow path 70 due to a change in the environment in which the liquid tank 30 is used (e.g., temperature or air pressure).

In the mounted state, the liquid communication flow path 80 (FIG. 8) forms a recessed flow path on its upper side. In the present embodiment, in the mounted state, the liquid communication flow path 80 forms an inverted U-shaped flow path. The liquid communication flow path 80 includes, in order starting from upstream in the ink flowing direction: an upstream end 82; an ascending flow path 83; a liquid intermediate flow path 86; a descending flow path 84; and a downstream end portion 852 including a downstream end 85. The flow path cross-sectional area of the liquid communication flow path 80 may be larger than the flow path cross-sectional area of the air communication flow path 70. The flow path cross-sectional area is the flow path cross-sectional area obtained when the flow path is cut with a plane orthogonal to the direction in which the liquid flowing through the flow path flows. When the flow path cross-sectional area of the liquid communication flow path 80 is larger than the flow path cross-sectional area of the air communication flow path 70, the ink in the first liquid chamber 51 flows more easily to the liquid communication flow path 80 compared to the case of being less than or equal to the flow path cross-sectional area of the air communication flow path 70. In the present embodiment, the flow path cross-sectional area of the thinnest location of the liquid communication flow path 80 is greater than the flow path cross-sectional area of the thickest location of the air communication flow path 70. Accordingly, the liquid tank 30 can suppress the flow of the liquid stored in the first liquid chamber 51 into the air communication flow path 70.

The upstream end 82 is an opening formed in the peripheral wall 518 of the first liquid chamber 51 and is coupled to the first liquid chamber 51. The ascending flow path 83 is located downstream of the upstream end 82, and extends upward in the mounted state and in the flowing direction. In the present embodiment, the ascending flow path 83 extends in the vertical upward direction from the upstream end 82. Note that in another embodiment, the ascending flow path 83 may also extend obliquely as long as there is an upward component. Here, in the mounted state, the inlet opening portion 547 is arranged at a position lower than that of the upstream end 82. That is, the inlet opening portion 547 is arranged at a position near the bottom wall 517 with respect to the upstream end 82.

Here, since the ink includes pigment particles, the pigment particles aggregate due to ink coming into contact with a gas and undergoing a pressure change due to opening and closing of the valve mechanism 60, resulting in foreign matter in some cases. As described above, since the inlet opening portion 547 is arranged at a position lower than that of the upstream end 82 in the mounted state, it is possible to prevent the level of the ink from becoming lower than the inlet opening portion 547. Accordingly, since it is possible to prevent air from being present in the periphery of the inlet opening portion 547, it is possible to reduce the likelihood that foreign matter will occur in the periphery of the inlet opening portion 547. Accordingly, it is possible to reduce the likelihood that foreign matter will flow into the liquid ejection head 12.

The liquid intermediate flow path 86 couples the ascending flow path 83 and the descending flow path 84. In the mounted state, the liquid intermediate flow path 86 has a liquid-side uppermost portion 861, which is at the highest position on the liquid communication flow path 80. That is, in the mounted state, the liquid intermediate flow path 86 is a portion that is higher than the upstream end 82 and the downstream end 85 that form both ends of the liquid communication flow path 80. The liquid intermediate flow path 86 is a flow path in which the flow of ink changes from upward to downward, and is a flow path bent 180 degrees. Also, in the mounted state, the liquid intermediate flow path 86 is arranged at a position lower than that of the highest portion (upstream end of an air second flow path 73) of the later-described air communication flow path 70.

The descending flow path 84 is located upstream of the ascending flow path 83 and the liquid intermediate flow path 86 in the flow direction, and extends downward in the mounted state. In the present embodiment, the descending flow path 84 extends in the vertical downward direction from the liquid intermediate flow path 86. Note that in another embodiment, the descending flow path 84 may also extend obliquely as long as there is a downward component.

The downstream end portion 852 is located downstream of the descending flow path 84 in the flow direction, and is coupled to the liquid supply portion 50. The downstream end portion 852 is formed as a coupling chamber that couples the descending flow path 84 and the liquid inlet 809 serving as the later-described upstream end of the liquid supply portion 50. The downstream end portion 852 includes the downstream end 85 to which the liquid inlet 809 is coupled. In the mounted state, the downstream end portion 852 may incline with respect to the horizontal direction so as to face more upward as the liquid supply portion 50 is approached, that is, toward the downstream end 85. Also, the inclination of the downstream end portion 852 may have an angle of 10 degrees or more and 45 degrees or less with respect to the horizontal direction. In the present embodiment, the inclination of the downstream end portion 852 has an angle of 15 degrees with respect to the horizontal direction. Here, the angle of the inclination of the downstream end portion 852 is the angle formed by the bottom face and the horizontal direction of the downstream end portion 852 (this angle is an acute angle). If the downstream end portion 852 is inclined as described above, it is possible to prevent air bubbles remaining in the liquid supply portion 50 from flowing into the liquid communication flow path 80. Accordingly, it is possible to prevent the liquid communication flow path 80 from being blocked by the air bubbles.

The air communication flow path 70 (FIG. 8) includes: an air-side coupling portion 72 that forms one end; an air first flow path 76 serving as an ascending air flow path; an air second flow path 73 serving as an inclined air flow path; an air third flow path 74; and a supply-side communication portion 75 that forms another end. In the mounted state, the air communication flow path 70 is coupled to the first liquid chamber 51 at a position higher than that of the upstream end 82, which is the position at which the liquid communication flow path 80 and the first liquid chamber 51 are coupled.

The air-side coupling portion 72 is an opening that is formed in the uppermost portion 519 in the peripheral wall 518. That is, in the mounted state, the air communication flow path 70 is coupled to the uppermost portion 519 of the first liquid chamber 51. In the mounted state, the air-side coupling portion 72 may be formed at a position that is the same height as or higher than the liquid-side uppermost portion 861 of the liquid communication flow path 80. In this case, with the first liquid chamber 51, the volume of the uppermost portion 519 can be increased compared to the case where the air-side coupling portion 72 is formed at a position lower than the liquid-side uppermost portion 861. In the present embodiment, the air-side coupling portion 72 is formed at a position that is higher than that of the liquid-side uppermost portion 861.

In the mounted state, the air first flow path 76 has the air-side coupling portion 72 at one end, and extends upward from the first liquid chamber 51. The air second flow path 73 couples the air first flow path 76 and the air third flow path 74 and extends in a direction including a horizontal direction component (in the present embodiment, the X axis direction) in the mounted state. In the mounted state, the air third flow path 74 extends downward from the air second flow path 73. The air third flow path 74 is coupled to the liquid supply portion 50 via the supply-side coupling portion 75. The supply-side coupling portion 75 is formed as a coupling chamber that couples the air third flow path 74 and the liquid inlet 809.

In the mounted state, the air second flow path 73 may be a flow path that extends in the direction of being inclined with respect to the horizontal direction. The air second flow path 73 may also be inclined with an angle of 10 degrees or more and 45 degrees or less with respect to the horizontal direction. Here, the angle of the air second flow path 73 with respect to the horizontal direction is an angle formed by the bottom face of the air second flow path 73 and horizontal direction (this angle is an acute angle). Due to the air second flow path 73 extending in a direction of being inclined with respect to the horizontal direction, when the ink flows into the air second flow path 73, the ink that has flowed therein is more likely to flow from the air second flow path 73 to the air first flow path 76 or the air third flow path 74 compared to the case of extending along the horizontal direction. For this reason, the ink that has flowed into the air second flow path 73 can be prevented from accumulating in the air second flow path 73. Accordingly, it is possible to prevent the air second flow path 73 from being blocked by the ink that has flowed into the air second flow path 73. Note that the flowing of the ink into the air second flow path 73 occurs due to, for example, changes in the temperature and air pressure, and inversion or shaking of the liquid tank 30. In the present embodiment, in the mounted state, the entirety of the air second flow path 73 inclines downward as it approaches the air third flow path 74, and has an angle of 15 degrees with respect to the horizontal direction.

The supply-side coupling portion 75, which is the downstream end of the air communication flow path 70, may be located directly above the later-described liquid inlet 809 of the liquid supply portion 50 in the mounted state. Being located directly above means being arranged such that, in a view from the Z axis direction, at least part of the supply-side coupling portion 75 and the liquid inlet 809 overlap. The center of the flow path cross-section of the supply-side coupling portion 75 and the center of the flow path cross-section of the liquid inlet 809 may also be arranged so as to approximately overlap. When the supply-side coupling portion 75 is located directly above the liquid inlet 809, the air bubbles remaining in the liquid supply portion 50 ascend and are thus more likely to flow into the air communication flow path 70, compared to the case where the supply-side coupling portion 75 is not located directly above the liquid inlet 809. Accordingly, the flow of the air bubbles remaining in the liquid supply portion 50 into the liquid communication flow path 80 is suppressed. In the present embodiment, the supply-side coupling portion 75 is located directly above the liquid inlet 809.

In the mounted state, the liquid supply portion 50 (FIG. 7) is located below the downstream end 85. Also, in the mounted state, the liquid supply portion 50 extends downward toward the liquid supply port 505. In the present embodiment, in the mounted state, the liquid supply portion 50 extends in the vertical downward direction toward the liquid supply port 505, but in another embodiment, it may extend obliquely as long as it includes a downward component.

The liquid supply portion 50 (FIG. 8) includes a liquid inlet 809, a first supply portion 501, and a second supply portion 502. The liquid inlet 809 forms the upstream end of the liquid supply portion 50 in the ink flow direction. In the mounted state, the liquid inlet 809 is open in the vertical upward direction. The first supply portion 50 internally has a flow path that is coupled to the liquid inlet 809. The first supply portion 501 is formed in the tank main body 40. The second supply portion 502 is coupled to the first supply portion 501. In the mounted state, the second supply portion 502 is formed by a member that protrudes vertically downward from the lower face 402. The second supply portion 502 has the liquid supply port 505. In the mounted state, the liquid supply port 505 is open in the vertical downward direction.

As shown in FIG. 8, when the liquid tank 30 is viewed from one side (−Y axis direction side) of the one side wall 408, the liquid injection portion 42 and the liquid supply port 505 are arranged at positions at opposite corners. For example, when the liquid tank 30 is viewed from one side (−Y axis direction side) of the one side wall 408, the liquid injection portion 42 is located on the vertically upward side with respect to the first liquid chamber 51 and the one side (+X axis direction side) in the horizontal direction (e.g., the X axis direction) with respect to the inlet opening portion 547 of the first liquid chamber 51 in the mounted state. Also, when the liquid tank 30 is viewed from one side (−Y axis direction side) of the one side wall 408, the liquid supply port 505 is located on the vertical downward direction side with respect to the first liquid chamber 51 and on the other side (−X axis direction side) of the horizontal direction (e.g., the X axis direction) with respect to the inlet opening portion 547 of the first liquid chamber 51. Accordingly, since the distance from the liquid injection portion 42 to the liquid supply port 505 can be prevented from becoming shorter, it is possible to reduce the likelihood that air bubbles will reach the liquid supply port 505, even if air bubbles occur when the ink is injected into the second liquid chamber 52 from the liquid injection portion 42. Accordingly, since the air bubbles retained near the liquid supply port 505 in the liquid supply portion 50 can be reduced, it is possible to reduce the likelihood that the air bubbles will flow into the liquid ejection head 12. Also, since the flow path through which the ink flows from the liquid injection portion 42 to the liquid supply port 505 can be arranged efficiently, it is possible to suppress a size increase of the liquid tank 30.

Next, the atmospheric air communication portion 300 will be described with reference to FIGS. 9 and 10. The terms "upstream" and "downstream" used in the description of the atmospheric air communication portion 300 are based on the flow direction of the fluid (air) from the outside to the second liquid chamber 52.

The atmospheric air communication portion 300 includes, in order starting from upstream: an atmospheric air release portion 44 serving as the upstream end; the first atmospheric air flow path 302 (FIG. 9); the second atmospheric air flow path 304 (FIG. 9); a winding flow path 306 (FIG. 9); an air-liquid separation chamber 308 (FIG. 9); a buffer chamber 310 (FIG. 10); an atmospheric air intermediate flow path 372 (FIG. 9); and an atmospheric air introduction portion 340 serving as the downstream end. Here, in the atmospheric air communication portion 300, various flow paths formed on one side (−Y axis direction side) of the one side wall 408 are defined by the tank main body 40 and the first film 91 (FIG. 4), and the various flow paths formed on the other side (+Y axis direction side) of the one side wall 408 are defined by the tank main body 40 and the third film 93 (FIG. 4). The buffer chamber 310 includes, in order starting from upstream: a first buffer chamber 312; a second buffer chamber 314; a third buffer chamber 316; a fourth buffer chamber 318; and a fifth buffer chamber 319.

The atmospheric air release portion 44 (FIG. 9) is a cylindrical member that extends in the +Z axis direction from a portion on the rear face 403 side of the upper face 401. The first atmospheric air flow path 302 (FIG. 9) is a flow path that couples the atmospheric air release portion 44 and the second atmospheric air flow path 304. The second atmospheric air flow path 304 is a long and narrow flow path that extends along the X axis direction. The winding flow path 306 is a flow path that couples the second atmospheric air flow path 304 and the air-liquid separation chamber 308. The winding flow path 306 is a flow path that is long and narrow and winds in order to lengthen the flow path length of the atmospheric air communication portion 300. Accordingly, the moisture in the ink of the second liquid chamber 52 can be prevented from evaporating. An air-liquid separation film (not shown) is arranged in the inner peripheral wall 307 of the air-liquid separation chamber 308. The air-liquid separation film is formed using a raw material that allows transmission of gas but does not allow transmission of ink. The downstream end of the air-liquid separation chamber 308 is a through hole 331 that penetrates through the one side wall 408. The air-liquid separation chamber 308 and the first buffer chamber 312 (FIG. 10) are coupled using the through hole 331. The first buffer chamber 312 is in communication with the second buffer chamber 314 via a gap between the third film 93 and the +Y axis direction side end face of the tank main body 40.

The second buffer chamber 314 and the first intermediate coupling flow path 341 (FIG. 8) are in communication using the through hole 332 that penetrates through the one side wall 408. The downstream end of the first intermediate coupling flow path 341 is a through hole 333 that penetrates through the one side wall 408. The first intermediate coupling flow path 341 and the third buffer chamber 316 (FIG. 10) are in communication using the through hole 333. The third buffer chamber 316 and the second intermediate coupling flow path 344 are in communication using the through hole 334 that penetrates through the one side wall 408. The second intermediate coupling flow path 344 and the fourth buffer chamber 318 are in communication using the through hole 335 that penetrates through the one side wall 408. The fourth buffer chamber 318 and the third intermediate coupling flow path 371 are in communication using the through hole 336 that penetrates through the one side wall 408. The third intermediate coupling flow path 371 and the fifth buffer chamber 319 are in communication using a through hole 337 that penetrates through the one side wall 408 and a cut-out portion 338 formed in the periphery of the through hole 337. The bottom face 319*a* of the fifth buffer chamber 319 is inclined so as to be located lower from the cut-out portion 338, which is upstream, to the through hole 339, which is downstream. Accordingly, even if ink enters the fifth buffer chamber 319 through the through hole 339, it is possible to reduce the likelihood that the ink will reach the cut-out portion 338.

The fifth buffer chamber 319 and the atmospheric air intermediate flow path 372 are in communication using the through hole 339 that penetrates through the one side wall 408. The atmospheric air intermediate flow path 372 and the second liquid chamber 52 are in communication using the atmospheric air introduction port 340*a* of the atmospheric air introduction portion 340 that penetrates through the one side wall 408. In the mounted state, the atmospheric air introduction portion 340 is located near the upper face of the second liquid chamber 52.

Note that as shown in FIG. 10, ribs 801 for holding the rigidity of the tank main body 40 are formed at locations of the tank main body 40 of the present embodiment. For example, multiple ribs 801 are provided in the fifth buffer chamber 319 and the second liquid chamber 52, which have relatively large spaces. The ribs 801 are formed coupled to the side walls defining the fifth buffer chamber 319 and the second liquid chamber 52. Accordingly, deformation during molding of the tank main body 40 can be prevented. Also, when the third film 93 is welded to the tank main body 40, deformation of the faces 401 to 404 can be prevented. Also, the fifth wall 409 is provided at a position opposing the front face (first wall) 404, and a rib 802 with a shape that protrudes in the +X axis direction is provided on the fifth wall 409. The rib 802 is a rib for coming into contact with an eject pin to be used when molding the tank main body 40. Here, the length of the rib 802 in the +Y axis direction from the one side wall 408 is shorter than the length of the fifth wall 409 in the +Y axis direction from the one side wall 408. That is, the rib 802 is not welded to the third film 93.

Note that the ribs 801 and 802 can be arranged appropriately according to the size of the tank main body 40, the thicknesses of the walls 401 to 404, the eject method used during molding, or the like.

Next, a detailed configuration of the liquid tank 30 will be further described with reference to FIGS. 10 and 11. Note that FIG. 11 is a partial perspective view of the tank main body 40, and is a perspective view of a cross-section taken along line A-A in FIG. 10, viewed from the −X axis direction.

Figure 11:
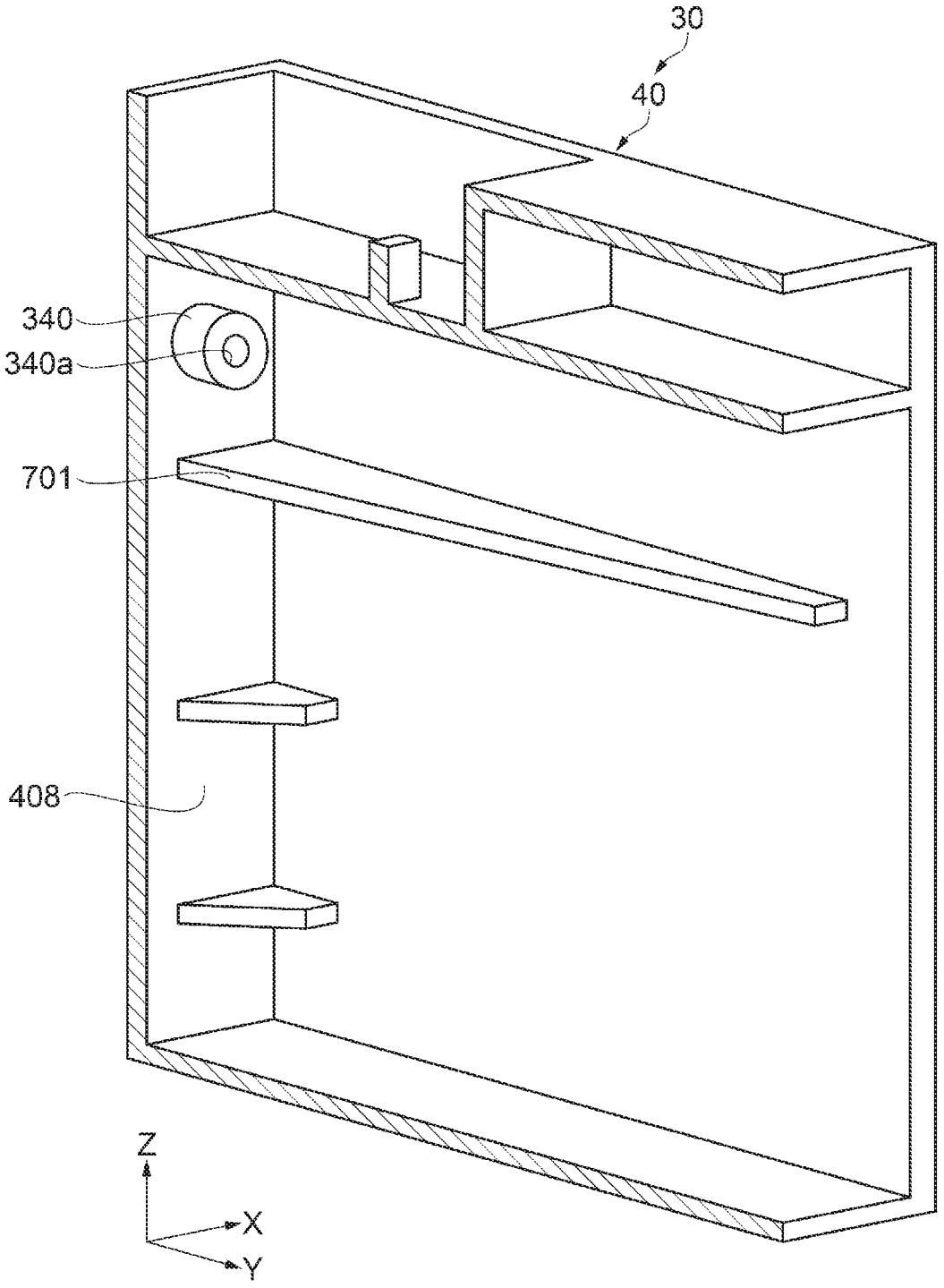
FIG. 11 is a perspective view of part of the tank main body.

As shown in FIGS. 10 and 11, in the liquid tank 30, an atmospheric air introduction portion 340 that penetrates through the one side wall 408 has been formed in the second liquid chamber 52. Also, in the full state, in which the second liquid chamber 52 is filled with ink to the highest level in a predetermined allowed range, the atmospheric air introduction port 340*a* of the atmospheric air introduction portion 340 is arranged at a position higher than the highest position of a wave generated due to reciprocal movement of the carriage 19.

Here, the full state of the ink in the liquid tank 30 of the present embodiment refers to a state in which the second liquid chamber 52 has been filled with ink from the second liquid chamber bottom face 404*fa* (FIG. 6) to the −Z axis direction end portion of the fifth wall 409. Note that in FIG. 10, the liquid surface LS of the ink in the full state is illustrated.

When the ink is in the full state in the liquid tank 30 and the carriage 19 is moved reciprocally in the Y axis direction with the liquid tank 30 equipped on the carriage 19, waves are formed in the ink in the second liquid chamber 52 accompanying the sliding operation of the carriage 19, but the atmospheric air introduction port 340*a* is arranged at a position higher than the highest level of the waves in the ink. Accordingly, the ink is not likely to stick to the atmospheric air introduction port 340*a*.

Also, the atmospheric air introduction portion 340 forms a hollow protrusion that protrudes from the third wall (right side face) 406 to the fourth wall (left side face) 405, and the atmospheric air introduction port 340*a* is located on the end portion of the hollow protrusion. The atmospheric air introduction portion 340 of the present embodiment has a circular tube shape. Note that strictly speaking, the atmospheric air introduction portion 340 has a hollow protrusion that protrudes from the one side wall 408 to the fourth wall (left side face). Also, the hollow protrusion of the atmospheric air introduction portion 340 is provided protruding to an intermediate position between the one side wall 408 (third wall 406) and the fourth wall 405.

The height of the waves in the ink caused by the reciprocal movement of the carriage 19 tends to be higher near a wall, such as the one side wall 408 (third wall 406) or the fourth wall 405, compared to at the intermediate position between the one side wall 408 (third wall 406) and the fourth wall 405. For this reason, the atmospheric air introduction portion 340 is a hollow protrusion, and by removing the atmospheric air introduction port 340 from near the one side wall 408 (third wall 406) or the fourth wall 405, it is possible to make it less likely that the ink in which the waves are formed will stick to the atmospheric air introduction port 340*a*.

Note that the shape of the atmospheric air introduction portion 340 is not limited to being a circular tube shape. For example, it is also possible to use a rectangular column shape.

Also, an end portion of the hollow protrusion of the atmospheric air introduction portion 340 may protrude to an intermediate position between the one side wall 408 (third wall 406) and the fourth wall 405. If this configuration is used, the atmospheric air introduction port 340*a* is located at the central portion between the one side wall 408 (third wall 406) and the fourth wall 405 and the waves in the ink correspond to a lower position, and therefore it is possible to further reduce the sticking of ink to the atmospheric air introduction port 340*a*.

Also, the atmospheric air introduction port 340*a* is arranged between the first wall (front face) 404 and the fifth wall 409. Then, a plate-shaped first rib 701 (rib) is arranged between the liquid surface LS of the ink in the full state of the ink, and the atmospheric air introduction port 340*a*. The first rib 701 is coupled to the one side wall 408 (third wall 406) and protrudes from the first wall 404 to the fifth wall 409.

When the waves in the ink occur accompanying reciprocal movement of the carriage 19, the waves in the ink collide with the first rib 701, and therefore the first rib 701 suppresses entry of the ink into the atmospheric air introduction port 340*a*, and prevents sticking of the ink to the atmospheric air introduction port 340*a*.

Also, the end portion of the first rib 701 is not coupled to the fifth wall 409, and a gap 711 is provided between the end portion on the fifth wall 409 side of the first rib 701 and the fifth wall 409. Accordingly, even if the ink lands on the first rib 701, the ink on the first rib 701 can drop down through the gap 711, and the ink on the first rib 701 can be prevented from reaching the atmospheric air introduction port 340*a*.

As described above, according to the present embodiment, the following effects can be obtained.

When ink contained in the ink tank 30 (second liquid chamber 52) is agitated due to reciprocal movement (sliding operation) in the Y axis direction of the carriage 19, waves are formed in the ink, and there is a risk that the waves in the ink will stick in the form of a film to the atmospheric air introduction port 340*a*. In this case, if air enters the second liquid chamber 52 from the atmospheric air introduction port 340*a* while in the form of a film, the film will expand, and thereafter, when the expanded film ruptures, multiple air bubbles will be formed and be present in the second liquid chamber 52. Upon doing so, the air bubbles will flow out to the liquid ejection head 12, which will incur an ink ejection inconvenience. However, according to the present embodiment, the atmospheric air introduction port 340*a* is arranged at a position higher than the highest level of the waves that occur due to the reciprocal movement of the carriage 19. For this reason, the ink is less likely to stick to the atmospheric air introduction port 340*a*, and therefore it is possible to prevent the formation of a film and to suppress the occurrence of air bubbles.

Also, when waves in the ink occur due to the reciprocal movement of the carriage 19, the waves collide with a first rib 701, and therefore it is possible to further suppress sticking of the ink to the atmospheric air introduction port 340*a*.

Note that a case is also possible in which air bubbles occur due to the waves themselves in the ink (agitation of the ink) caused by the reciprocal movement of the carriage 19. In this case, the air bubbles can be trapped by the filter member 541 provided downstream of the second liquid chamber 52, and the air bubbles can be prevented from flowing out to the liquid ejection head 12. Note that the air bubbles trapped by the filter member 541 can be guided to the second liquid chamber 52 via the influx opening 548 and downstream flow of the air bubbles can be reduced.

Furthermore, with the liquid tank 30 of the present embodiment, the winding path 543*a* (defoaming portion 543) is provided between the filter member 541 and the valve mechanism 60. That is, the winding path 543*a* (defoaming portion 543) is provided on the upstream liquid communication path, in which the ink is in a positive pressure state. Accordingly, even if minute air bubbles flow out via the filter member 541, the air bubbles can be dissolved in the ink and eliminated.

As described above, the liquid tank 30 equipped on the liquid ejection apparatus 1 of the present embodiment has a configuration for suppressing the occurrence of air bubbles, and for eliminating occurring air bubbles even if air bubbles occur, for example, and therefore it is possible to prevent the occurrence of an ink ejection inconvenience.

Note that the present disclosure is not limited to the above-described embodiments, and various modifications, improvements, and the like can be added to the above-described embodiments. Variations will be stated hereinafter.

Variation 1

With the liquid tank 30 of the above-described embodiment, a configuration was used in which one first rib 701 for suppressing waves in the ink is provided, but there is no limitation to this, and it is also possible to provide multiple ribs.

Figure 12:
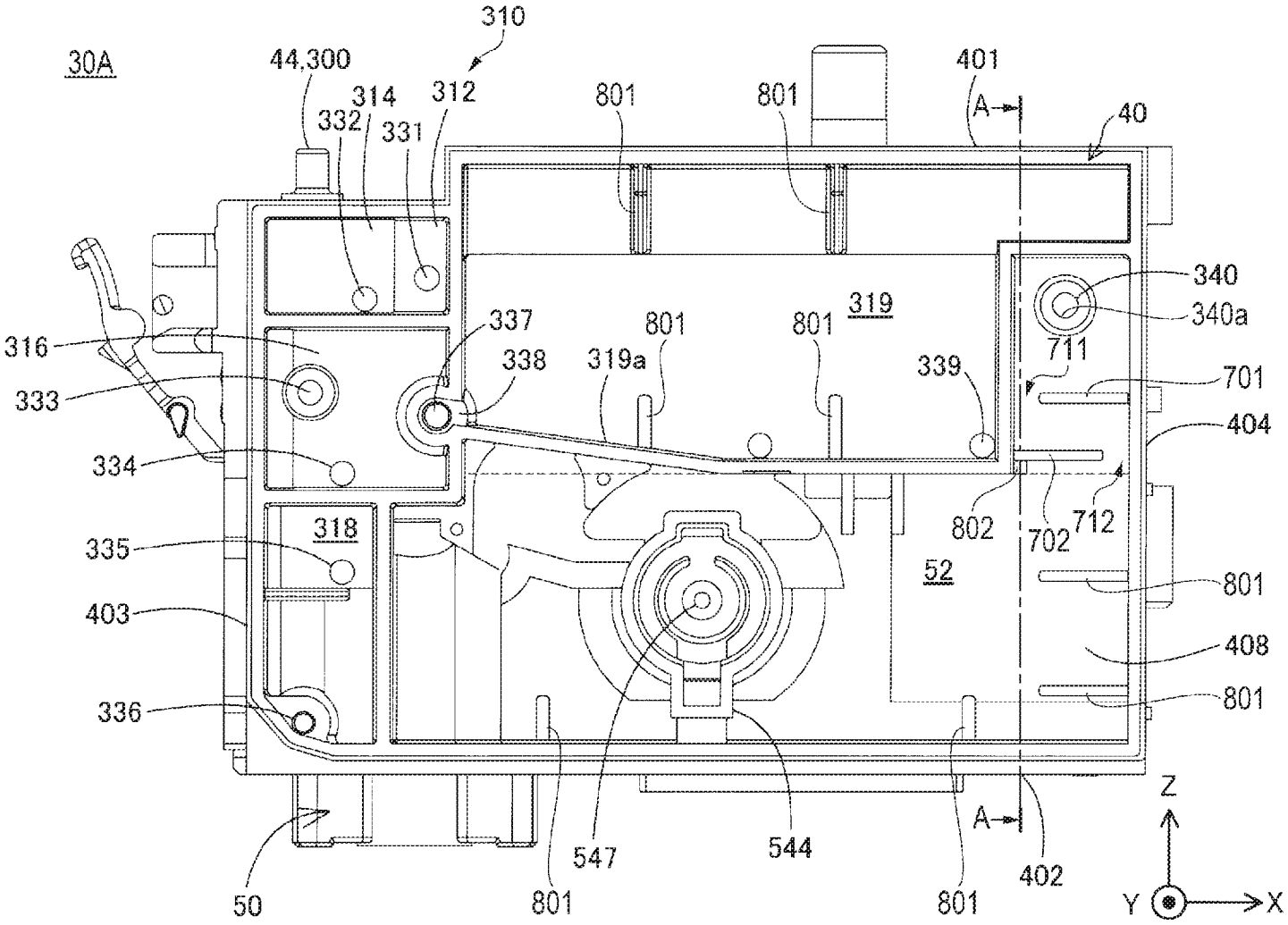
FIG. 12 is a schematic view showing a configuration of the liquid tank according to Variation 1.

FIG. 12 is a schematic diagram showing a configuration of a liquid tank 30A according to the present variation. As shown in FIG. 12, the liquid tank 30A is provided with a second rib 702 in addition to the first rib 701. Specifically, in the second liquid chamber 52, the second rib 702 is arranged between the liquid surface LS of the ink in the full state of the ink, and the atmospheric air introduction port 340*a*. The second rib 702 is coupled to the one side wall 408 (third wall 406) and protrudes from the fifth wall 409 to the first wall 404. That is, the first rib 701 and the second rib 702 are aligned alternatingly in the Z axis direction. The second rib 702 is arranged in the −Z axis direction of the first rib 701. Note that the second rib 702 may also be arranged in the +Z axis direction of the first rib 701.

Also, a gap 712 is provided between the end portion on the first wall 404 side of the second rib 702 and the first wall 404. Accordingly, even if ink lands on the second rib 702, the ink on the second rib 702 can drop down through the gap 712, and the ink on the second rib 702 can be prevented from reaching the atmospheric air introduction port 340*a*.

If this configuration is used, when waves occur in the ink due to the reciprocal movement of the carriage 19, the waves in the ink collide with the first rib 701 and the second rib 702, which are aligned alternatingly, and furthermore, the ink can be prevented from entering or sticking to the atmospheric air introduction portion 340*a*.

Note that configurations other than those of the second rib 702 and the gap 712 in the liquid tank 30A are similar to those of the embodiments, and therefore description thereof is not included.

Variation 2

In the above-described embodiment, the atmospheric air introduction portion 340 including the atmospheric air introduction port 340*a* was arranged on the one side wall 408 side, but there is no limitation to this. For example, the atmospheric air introduction portion 340 may also be provided on the upper face (upper wall) 401 side. In this case, the atmospheric air introduction port 340*a* is arranged facing the −Z axis direction. In this manner as well, the above-described effects can be obtained.

Variation 3

In the above-described embodiment, a configuration was used in which the winding path 543*a* was provided on the defoaming portion 543, but there is no limitation to this. For example, the defoaming portion 543 need only be a space having a volume similar to the volume of the entirety of the winding path 543*a*. That is, on the upstream liquid communication path, the defoaming portion 542 eliminates minute air bubbles while the ink reaches from the filter chamber 542 to the valve mechanism 60, and therefore the defoaming portion 543 need only be a space for retaining the ink. In this manner as well, the air bubbles can be dissolved in the ink.

Variation 4

The liquid ejection apparatus 1 of the above-described embodiment is not limited to an inkjet printer, and the liquid tank 30 of the above-described embodiment is not limited to a container that is configured to supply ink. The present disclosure can be applied also to any liquid ejection apparatus that ejects a liquid other than ink, and a liquid tank that is configured to contain that liquid. For example, the present disclosure can be applied to the following types of liquid ejection apparatuses and liquid tanks thereof.

(1) Image recording apparatuses such as a facsimile apparatus, (2) Color material ejection apparatuses used to manufacture color filters for image display apparatuses such as a liquid crystal display, (3) Electrode material ejection apparatuses used to form electrodes for organic EL (Electro Luminescence) displays, surface light emission displays (field emission displays, FED), or the like, (4) Liquid ejection apparatuses that eject liquid containing biological organic matter used to manufacture biochips, (5) Sample ejection apparatuses serving as precision pipettes, (6) Lubricating oil ejection apparatuses, (7) Resin liquid ejection apparatuses, (8) Liquid ejection apparatuses that perform pinpoint ejection of lubricating oil to precision machines such as a watch and a camera, (9) Liquid ejection apparatuses that eject transparent resin liquid such as UV-cured resin liquid onto substrates in order to form micro-hemispherical lenses (optical lenses) or the like used in optical communication elements or the like,

(10) Liquid ejection apparatuses that eject acid or alkaline etchant in order to etch substrates or the like, and

(11) Liquid ejection apparatuses that include liquid ejection heads for discharging a very small amount of any other kinds of droplet.

Note that "droplet" refers to a state of a liquid discharged from a liquid ejection apparatus, and includes droplets having a granular shape, a tear-drop shape, and a shape with a thread-like trailing end. In addition, the "liquid" mentioned here need only be a material, which can be ejected by a liquid ejection apparatus. For example, the "liquid" need only be a material in a state where a substance is in a liquid phase, and a liquid material having a high or low viscosity, sol, gel water, and other liquid materials such as an inorganic solvent, organic solvent, solution, liquid resin, and liquid metal (metallic melt) are also included as a "liquid". Furthermore, the "liquid" is not limited to being a single-state substance, and also includes particles of a functional material made from solid matter, such as pigment or metal particles, that are dissolved, dispersed, or mixed in a solvent, or the like. In addition, representative examples of the liquid include ink such as that described in the above embodiment, liquid crystal, or the like. Here, the "ink" encompasses general water-based ink and oil-based ink, as well as various types of liquid compositions such as gel ink and hot melt ink.

Hereinafter, content extracted from the embodiments will be described.

The liquid ejection apparatus includes: a liquid ejection head that ejects a liquid; a liquid container that is in communication with the liquid ejection head and is configured to supply the liquid to the liquid ejection head; and a carriage that is for arranging the liquid ejection head and the liquid container and is configured to perform a reciprocal movement. The liquid container includes: a liquid containing chamber that is configured to contain the liquid; a liquid injection port that is configured to inject the liquid into the liquid containing chamber from outside; an atmospheric air introduction port that introduces atmospheric air into the liquid containing chamber from the outside; and a liquid supply port that is configured to supply the liquid to the outside from the liquid containing chamber. The liquid containing chamber includes: an upper wall in a use state; a bottom wall opposing the upper wall; a first wall that intersects the upper wall and the bottom wall and is parallel to the direction of the reciprocal movement; a second wall opposing the first wall; a third wall that intersects the first wall and the second wall; and a fourth wall opposing the third wall. The atmospheric air introduction port is arranged at a position higher than the highest level of a wave that occurs due to the reciprocal movement in a full state in which the liquid containing chamber is filled with liquid to the highest level in a predetermined containing range.

When the liquid contained in the liquid containing chamber is agitated due to the reciprocal movement of the carriage, waves are formed in the liquid in the liquid containing chamber, and the waves in the liquid stick in the form of a film to the atmospheric air introduction port. Then, when air enters through the atmospheric air introduction port while in the form of a film, the film expands. Thereafter, when the expanded film ruptures, multiple air bubbles are formed and are present in the liquid containing chamber. Accordingly, when the air bubbles flow out to the liquid ejection head, a liquid ejection inconvenience occurs. However, according to the above-described configuration, the atmospheric air introduction port is arranged at a position higher than the highest level of the waves that occur due to the reciprocal movement of the carriage. For this reason, the liquid is less likely to stick to the atmospheric air introduction port, and therefore formation of a film can be prevented, and the occurrence of air bubbles can be suppressed.

The atmospheric air introduction port of the above-described liquid ejection apparatus may be located at an end portion of a hollow protrusion protruding toward the fourth wall from the third wall.

The height of the waves in the liquid contained in the liquid containing chamber, the waves being caused by the reciprocal movement of the carriage, tends to be higher near a wall, such as the third wall or the fourth wall. According to the above-described configuration, the atmospheric air introduction port is formed at the end portion of the hollow protrusion. Accordingly, the position of the atmospheric air introduction port is arranged at a position located away from the third wall, and therefore the liquid in which the waves are formed can be made less likely to stick to the atmospheric air introduction port. Accordingly, the occurrence of air bubbles can be suppressed.

The hollow protrusion of the liquid ejection apparatus may be provided protruding from the third wall to an intermediate position between the third wall and the fourth wall.

According to this configuration, the position of the atmospheric air introduction port corresponds to a lower position of the waves in the liquid compared to near the third wall or near the fourth wall. Accordingly, the liquid in which the waves are formed can be made even less likely to stick to the atmospheric air introduction port.

The atmospheric air introduction port of the above-described liquid ejection apparatus may be arranged between the first wall and a fifth wall that is provided between the first wall and the second wall and opposes the first wall, and the liquid containing chamber may include a rib arranged between a liquid surface of the liquid in the full state and the atmospheric air introduction port, the rib being coupled to the third wall and protruding toward the fifth wall from the first wall.

According to this configuration, when the waves in the liquid contained in the liquid containing chamber occur due to the reciprocal movement of the carriage, the waves in the liquid collide with the rib, and the entry of the liquid into the atmospheric air introduction port is suppressed. Accordingly, it is possible to make the liquid in which the waves occur less likely to stick to the atmospheric air introduction port.

In the above-described liquid ejection apparatus, a gap may be provided between an end portion on the fifth wall side of the rib and the fifth wall.

According to this configuration, even if the liquid lands on the rib, the liquid on the rib can drop down through the gap between the rib and the fifth wall, and thus the liquid on the rib can be prevented from reaching the atmospheric air introduction port.

In the above-described liquid ejection apparatus, letting the rib be a first rib, the liquid containing chamber may include a second rib that is arranged between the liquid surface of the liquid in the full state and the atmospheric air introduction port, the second rib being coupled to the third wall and protruding toward the first wall from the fifth wall.

According to this configuration, when the waves in the liquid contained in the liquid containing chamber occur due to the reciprocal movement of the carriage, the waves in the liquid collide with the first rib and the second rib, which are arranged alternatingly, and the liquid can be prevented from entering or sticking to the atmospheric air introduction port.

In the above-described liquid ejection apparatus, a gap may be provided between an end portion on the first wall side of the second rib and the first wall.

According to this configuration, even if the liquid lands on the second rib, the liquid on the second rib can drop down through the gap between the first rib and the second rib, and the liquid on the second rib can be prevented from reaching the atmospheric air introduction port.

In the above-described liquid ejection apparatus, the liquid container may include: a negative pressure generation mechanism provided between the liquid containing chamber and the liquid supply port; an upstream liquid communication path through which the liquid containing chamber and the negative pressure generation mechanism are in communication; and a downstream liquid communication path through which the negative pressure generation mechanism and the liquid supply port are in communication. The upstream liquid communication path may be in a positive pressure state, the downstream liquid communication path may be in a negative pressure state, and at least a portion of the upstream liquid communication path may include a defoaming portion that eliminates air bubbles in the liquid.

The air bubbles inflate in the negative pressure environment, whereas they can be dissolved in the liquid and eliminated in the positive pressure environment. In the above-described configuration, the defoaming portion is arranged in the upstream liquid communication portion in the positive pressure environment, and it is thereby possible to reduce the risk that the air bubbles will reach the liquid ejection head.

The defoaming portion of the above-described liquid ejection apparatus may be constituted by a winding path provided on the upstream liquid communication path.

According to this configuration, due to the liquid being retained in the long and narrow winding flow path in the upstream liquid communication path, the minute air bubbles (micro-bubbles) can be dissolved in the liquid.

In the above-described liquid ejection apparatus, a filter that traps the air bubbles may be provided on the upstream liquid communication path.

According to this configuration, the air bubbles are trapped by the filter, whereby it is possible to reduce the risk that the air bubbles will reach the liquid ejection head.

In the above-described liquid ejection apparatus, the bottom wall may be provided with a liquid outflow port that allows the liquid to flow out from the liquid containing chamber to the upstream liquid communication path, and the liquid outflow port may be arranged near the filter.

According to this configuration, the air bubbles that accumulate on the surface of the filter can be returned to the liquid containing chamber through swinging caused by the reciprocal movement of the carriage.

In the above-described liquid ejection apparatus, a viewing portion through which an amount of the liquid contained in the liquid containing chamber can be viewed from the outside may be provided in at least one of the first wall and the second wall.

According to this configuration, the amount of liquid contained in the liquid containing chamber can be easily checked via the viewing portion.

What is claimed is:

1. A liquid ejection apparatus comprising:

a liquid ejection head that ejects a liquid;

a liquid container that is in communication with the liquid ejection head and is configured to supply the liquid to the liquid ejection head; and a carriage that is for arranging the liquid ejection head and the liquid container and is configured to perform a reciprocal movement, wherein the liquid container includes:

a liquid containing chamber that is configured to contain the liquid;

a liquid injection port that is configured to inject the liquid into the liquid containing chamber from outside;

an atmospheric air introduction port that introduces atmospheric air into the liquid containing chamber from the outside; and a liquid supply port that is configured to supply the liquid to the outside from the liquid containing chamber, the liquid containing chamber includes:

an upper wall in a use state;

a bottom wall opposing the upper wall;

a first wall that intersects the upper wall and the bottom wall and is parallel to the direction of the reciprocal movement;

a second wall opposing the first wall;

a third wall that intersects the first wall and the second wall; and a fourth wall opposing the third wall, the atmospheric air introduction port is arranged at a position higher than the highest level of a wave that occurs due to the reciprocal movement in a full state in which the liquid containing chamber is filled with liquid to the highest level in a predetermined containing range, and the atmospheric air introduction port is located at an end portion of a hollow protrusion protruding toward the fourth wall from the third wall.

2. The liquid ejection apparatus according to claim 1, wherein the hollow protrusion is provided protruding from the third wall to an intermediate position between the third wall and the fourth wall.

3. A liquid ejection apparatus comprising:

a liquid ejection head that ejects a liquid;

a liquid container that is in communication with the liquid ejection head and is configured to supply the liquid to the liquid ejection head; and a carriage that is for arranging the liquid ejection head and the liquid container and is configured to perform a reciprocal movement, wherein:

the liquid container includes:

a liquid containing chamber that is configured to contain the liquid;

a liquid injection port that is configured to inject the liquid into the liquid containing chamber from outside;

an atmospheric air introduction port that introduces atmospheric air into the liquid containing chamber from the outside; and a liquid supply port that is configured to supply the liquid to the outside from the liquid containing chamber, the liquid containing chamber includes:

an upper wall in a use state;

a bottom wall opposing the upper wall;

a first wall that intersects the upper wall and the bottom wall and is parallel to the direction of the reciprocal movement;

a second wall opposing the first wall;

a third wall that intersects the first wall and the second wall; and a fourth wall opposing the third wall, the atmospheric air introduction port is arranged at a position higher than the highest level of a wave that occurs due to the reciprocal movement in a full state in which the liquid containing chamber is filled with liquid to the highest level in a predetermined containing range;

the atmospheric air introduction port is arranged between the first wall and a fifth wall that is provided between the first wall and the second wall and opposes the first wall, and the liquid containing chamber includes a rib arranged between a liquid surface of the liquid in the full state and the atmospheric air introduction port, the rib being coupled to the third wall and protruding toward the fifth wall from the first wall.

4. The liquid ejection apparatus according to claim 3, wherein a gap is provided between an end portion on the fifth wall side of the rib and the fifth wall.

5. The liquid ejection apparatus according to claim 3, wherein letting the rib be a first rib, the liquid containing chamber includes a second rib that is arranged between the liquid surface of the liquid in the full state and the atmospheric air introduction port, the second rib being coupled to the third wall and protruding toward the first wall from the fifth wall.

6. The liquid ejection apparatus according to claim 5, wherein a gap is provided between an end portion on the first wall side of the second rib and the first wall.

7. A liquid ejection apparatus comprising:

a liquid ejection head that ejects a liquid;

a liquid container that is in communication with the liquid ejection head and is configured to supply the liquid to the liquid ejection head; and a carriage that is for arranging the liquid ejection head and the liquid container and is configured to perform a reciprocal movement, wherein:

the liquid container includes:

a liquid containing chamber that is configured to contain the liquid;

a liquid injection port that is configured to inject the liquid into the liquid containing chamber from outside;

an atmospheric air introduction port that introduces atmospheric air into the liquid containing chamber from the outside; and a liquid supply port that is configured to supply the liquid to the outside from the liquid containing chamber, the liquid containing chamber includes:

an upper wall in a use state;

a bottom wall opposing the upper wall;

a first wall that intersects the upper wall and the bottom wall and is parallel to the direction of the reciprocal movement;

a second wall opposing the first wall;

a third wall that intersects the first wall and the second wall; and a fourth wall opposing the third wall, the atmospheric air introduction port is arranged at a position higher than the highest level of a wave that occurs due to the reciprocal movement in a full state in which the liquid containing chamber is filled with liquid to the highest level in a predetermined containing range; and the liquid container further includes:

a negative pressure generation mechanism provided between the liquid containing chamber and the liquid supply port;

an upstream liquid communication path through which the liquid containing chamber and the negative pressure generation mechanism are in communication; and a downstream liquid communication path through which the negative pressure generation mechanism and the liquid supply port are in communication, the upstream liquid communication path is in a positive pressure state, the downstream liquid communication path is in a negative pressure state, and at least a portion of the upstream liquid communication path includes a defoaming portion that eliminates air bubbles in the liquid.

8. The liquid ejection apparatus according to claim 7, wherein the defoaming portion is constituted by a winding path provided on the upstream liquid communication path.

9. The liquid ejection apparatus according to claim 8, wherein a filter that traps the air bubbles is provided on the upstream liquid communication path.

10. The liquid ejection apparatus according to claim 9, wherein the bottom wall is provided with a liquid outflow port that allows the liquid to flow out from the liquid containing chamber to the upstream liquid communication path, and the liquid outflow port is arranged near the filter.

11. The liquid ejection apparatus according to claim 1, wherein a viewing portion through which an amount of the liquid contained in the liquid containing chamber can be viewed from the outside is provided in at least one of the first wall and the second wall.

* * * * *